United States Patent [19]

Sera et al.

[11] 4,124,394

[45] Nov. 7, 1978

[54] COLOR DIFFUSION TRANSFER PHOTOGRAPHIC MATERIALS WITH SULFONE COLOR DEVELOPING AGENT SCAVENGERS

[75] Inventors: Hidefumi Sera; Motohiko Tsubota; Sosuke Hanai, all of Kanagawa, Japan

[73] Assignee: Fuji Photo Film Co., Ltd., Minami-ashirara, Japan

[21] Appl. No.: 754,802

[22] Filed: Dec. 27, 1976

[30] Foreign Application Priority Data

Dec. 29, 1975 [JP] Japan ..... 50/159256

[51] Int. Cl.[2] ..... G03C 7/00; G03C 5/54; G03C 1/40

[52] U.S. Cl. ..... 96/77; 96/3; 96/29 D; 96/56

[58] Field of Search ..... 96/3, 29 D, 77, 56, 96/100

[56] References Cited

U.S. PATENT DOCUMENTS 3,730,713 5/1973 Abbott ..... 96/29 D

*Primary Examiner*—Richard L. Schilling

*Attorney, Agent, or Firm*—Sughrue, Rothwell, Mion, Zinn and Macpeak

[57] ABSTRACT

In a color diffusion transfer photographic material which comprises a photosensitive element containing at least one silver halide emulsion layer having associated therein a non-diffusible dye image-providing material, an image-receiving element for immobilizing therein diffusible dye formed by the oxidation reaction of the dye image-providing material and a primary aromatic amino color developing agent to form dye images, and a processing composition for developing the exposed silver halide in the silver halide emulsion layer and transferring the diffusible dye formed into the image-receiving layer with at least one of the photosensitive elements, the image-receiving element or the processing composition containing a primary aromatic amino color developing agent or a precursor thereof, with the photosensitive element and/or the image-receiving element of the photographic material containing at least one of divinyl sulfone and a divinyl sulfone derivative represented by the formula (I):

$$B-CH_2CH_2-\overset{\overset{O}{\|}}{\underset{\underset{O}{\|}}{S}}-CH_2CH_2-B\,.\,(X^{\ominus})_n \qquad (I)$$

wherein B represents an atomic group necessary for forming an ammonium group, a sulfonium group or a phosphonium group; $X^-$ represents an acid anion; and $n$ is 0, 1 or 2.

15 Claims, No Drawings

COLOR DIFFUSION TRANSFER PHOTOGRAPHIC MATERIALS WITH SULFONE COLOR DEVELOPING AGENT SCAVENGERS

BACKGROUND OF THE INVENTION

1. Field of the Invention

This invention relates to color diffusion transfer photographic materials and, more particularly, to color diffusion transfer photographic materials to be developed with a primary aromatic amino color developing agent.

2. Description of the Prior Art

There are many patents and patent applications on photographic materials for the color diffusion transfer process by a primary aromatic amino color developing agent as will be described later and various dye image forming processes, dye image-providing materials, layer structures, formats, etc., for these color diffusion transfer photographic materials are well known. However, all of these conventional techniques are of the type that dye images are formed by the reaction of dye image-providing materials and the oxidized products of primary aromatic amino color developing agents. In such color diffusion transfer photographic materials, it is as a matter of course necessary for the dye image to be stable. That is, the dye images transferred to an image-receiving element in a color diffusion transfer process are very unstable when the processing composition remains spread thereover either when a photosensitive element is stripped from the image-receiving element or when the photo-sensitive element is not stripped from the image-receiving element and the dye images usually fade with the passage of time or formation of stain usually occurs in areas not bearing transferred dye images, the so-called "blank portions" of the image-receiving element.

Although not many reports have been made, several techniques for overcoming these drawbacks have been made.

For instance, Japanese Patent Application (OPI) No. 5424/73 (corresponding to U.S. Pat. 3,743,504) shows that the addition of an aldehyde-bisulfite addition product is effective for preventing the formation of stain in the blank portions of image-receiving elements. It is believed that the additive causes a reaction with excess unreacted primary aromatic amino color developing agent to form a colorless product, which results in reducing the formation of yellowish brown stain by the diffusion of the unreacted primary aromatic color developing agent into an image-receiving element. Also, Japanese Patent Application (OPI) No. 15134/72 (corresponding to U.S. Pat. No. 3,725,063) shows that the incorporation of an isocyanate-bisulfite addition product in a polymer binder is effective for preventing the formation of stain in the blank portions and in this case, it is also believed that the additive can prevent the formation of stain in the same manner as described above. Furthermore, Japanese Patent Application (OPI) No. 3836/73 (corresponding to U.S. Pat. No. 3,730,713) shows that the addition of a bis(vinylsulfonylalkyl) derivative or a polymer thereof is also effective for the prevention of stains and in this case it is said to markedly suppress the formation of stains by the same action as above.

The aldehyde-bisulfite addition product, the isocyanate-bisulfite addition product, the bis(vinylsulfonylalkyl) derivative (or the polymer thereof) are effective for preventing the formation of stains in the blank portions of image-receiving elements as stated above but these materials exhibit only a slight effect for the prevention of fading of color images.

Furthermore, the stabilization of color images is generally very important in photographic materials adapted for use in a color diffusion transfer process using a primary aromatic amino color developing agent. That is, in an ordinary color photographic process, the developer remaining on color photographic materials after developing the image-exposed color photographic materials (it is well known that such a developer adversely influences the stabilization of images formed) is removed therefrom by such processings as fixing, water washing, silver removal, etc. In other words, in an ordinary color photographic process, a "removal of spent developer" procedure, preferred for the stabilization of images, is performed. On the other hand, in a color diffusion transfer process, the processed photographic material retains therein the processing composition (i.e., a removal of the spent developer from the image-receiving element is not performed), the color images formed are quite unstable as can be easily understood.

SUMMARY OF THE INVENTION

An object of this invention is to provide color diffusion transfer photographic materials containing an additive removing or minimizing the above-described various drawbacks, in particular, reducing the formation of stains in the blank portions.

Another object of this invention is to provide color diffusion transfer photographic materials capable of forming stabilized color images, in particular, color images in which fading is prevented.

Still another object of this invention is to provide color diffusion transfer photographic materials of the type to be processed by a primary aromatic amino color developing agent, with the photographic materials providing stabilized color images unaccompanied by the formation of stains in the blank portions.

A further object of this invention is to provide color diffusion transfer photographic materials capable of forming stabilized color images in image-receiving elements and/or photosensitive elements of the photographic materials without forming stains.

As the result of various investigations, it has now been found that the above-described objects of this invention can be effectively attained by the color photographic materials of this invention as described below.

That is, according to this invention, there is provided a color diffusion transfer photographic material which comprises a photosensitive element containing at least one silver halide emulsion layer having associated therewith a non-diffusible dye image-providing material; an image-receiving element for immobilizing therein a diffusible dye formed by the oxidation reaction of the dye image-providing material and a primary aromatic amino color developing agent to form dye images; and a processing composition for developing the exposed silver halide in the silver halide emulsion layer and transferring by diffusion the diffusible dye to the image-receiving element of the photographic material and with the photographic material containing a primary aromatic amino color developing agent or a precursor thereof in at least one of the light-sensitive element, the image-receiving element or the processing composition, with the photographic material having incorporated therein at least one of divinyl sulfone and a divinyl sulfone derivative represented by general formula (I):

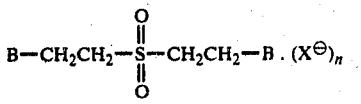

(I)

wherein B represents an atomic group necessary for forming an ammonium group (including $NH_4$, N-substituted ammonium and pyridinium groups), a sulfonium group, or a phosphonium group; $X^-$ represents an acid anion; and $n$ is 0, 1 or 2; the derivative forming an intramolecular salt in the moiety B when $n$ is 0.

DETAILED DESCRIPTION OF THE INVENTION

The additives used in this invention are explained below in detail.

In general formula (I), the preferred group represented by B is an ammonium group shown by the formula:

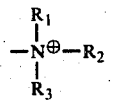

wherein $R_1$, $R_2$ and $R_3$, which may be the same or different, each represents a saturated or unsaturated, straight chain or branched chain aliphatic group having 1 to 7 carbon atoms (in which the group may have one or more substituents such as an aryl group (e.g., phenyl group), a carboxy group, a sulfo group, a hydroxy group, etc., with examples of unsubstituted saturated and unsaturated groups including a methyl group, an ethyl group, an isopropyl group, an allyl group, etc., and with examples of substituted saturated and unsaturated groups including a hydroxyethyl group, a benzyl group, a sulfopropyl group, an oxycarbonylmethyl group, etc.) and $R_1$, $R_2$ and $R_3$ may combine with each other to form a ring such as a 5-membered ring or 6-membered ring (e.g.,

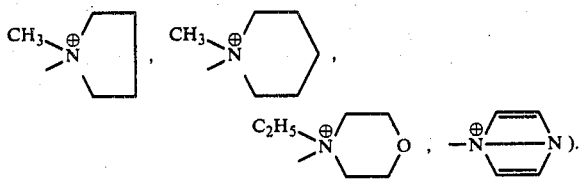

Also, the aliphatic group or the aryl group in the sulfonium group and the phosphonium group has the same significance as above.

$X^-$ in the above general formula represents an anion, e.g., an inorganic or organic anion, for rendering the divinyl sulfone derivative water soluble (e.g., $Cl^-$, $Br^-$, $SO_4^{2-}$, $NO_3^-$, $CH_3SO_4^-$, p-toluene sulfonate ion, etc.) and $n$ is 0, 1 or 2. When $n$ is 0, and when one of $R_1$, $R_2$ and $R_3$ is an aliphatic group substituted with an acid group such as a sulfo group or a carboxy group, the derivative of the general formula (I) forms an intramolecular salt (betaine structure).

The stabilization of color images of the advantages of this invention is one which has not been obtained by conventional techniques and thus this invention is particularly valuable from the standpoint that the quality of color photographs formed by a diffusion transfer process can be greatly improved.

Divinyl sulfone and preferred examples of divinyl sulfone derivatives used in this invention are illustrated below in terms of their chemical formulae.

Compound 1

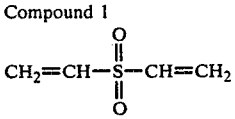

Compound 2

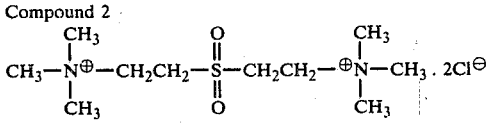

Compound 3

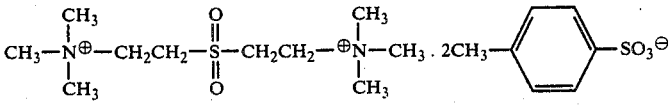

Compound 4

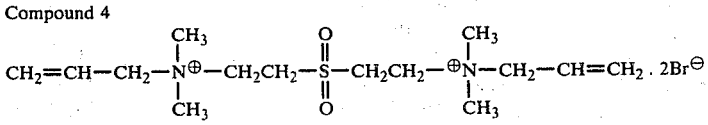

Compound 5

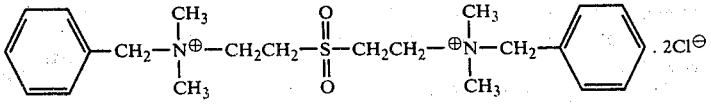

Compound 6

-continued

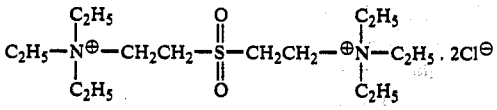

Compound 7

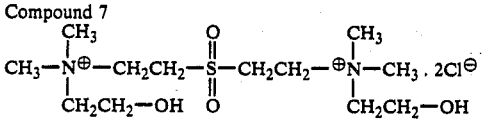

Compound 8

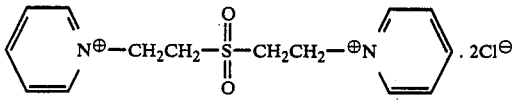

Compound 9

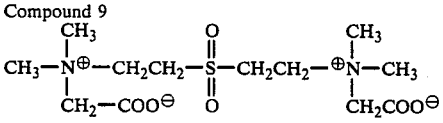

Compound 10

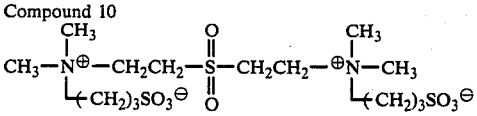

Of the above-illustrated compounds which can be used in this invention, divinyl sulfone is a well-known compound and is readily available commercially. Furthermore, the divinyl sulfone derivatives shown by the general formula (I) can be prepared in good yield from divinyl sulfone using well-known methods, e.g., as disclosed in British Pat. No. 915,572 and *J. Chem. Soc.*, 1949, 2433–2440.

That is, the divinyl sulfone derivatives of the general formula (I) can be prepared by an addition reaction of divinyl sulfone and a tertiary amine salt, an addition reaction of a reaction product of divinyl sulfone and HCl, etc., and a tertiary amine, or a reaction converting the addition product of divinyl sulfone and a secondary amine into the quaternary ammonium salt thereof using a material for forming a quaternary ammonium salt (e.g., methyl p-toluenesulfonate, allyl bromide, propanesultone, methyl bromide, dimethyl sulfate, methyl methanesulfonate, and sodium monochloroacetate).

Typical examples of preparing the divinyl sulfone derivatives which can be used in this invention are shown below. Unless otherwise indicated herein, all parts, percents, ratios and the like are by weight.

SYNTHESIS EXAMPLE 1

Synthesis of Compound 2

In 200 ml of absolute ethanol were dissolved 23 g of trimethylamine hydrochloride and 11.8 g of divinyl sulfone and the solution was allowed to stand overnight at 30° C., whereby white crystals precipitated. The crystals were recovered by filtration and dried to provide 25 g of the desired compound having a melting point higher than 240° C.

Elemental Analysis

| | C | H | N |
|---|---|---|---|
| Calculated: | 38.84% | 8.41% | 9.06% |
| Found: | 38.72% | 8.68% | 8.91% |

SYNTHESIS EXAMPLE 2

Synthesis of Compound 3

In 200 ml of anhydrous acetone was dissolved 5.9 g of divinyl sulfone and then dimethylamine gas (anhydrous) was bubbled into the solution for reaction at 0°–10° C. After distilling acetone and excess dimethylamine from the reaction product under reduced pressure, the residue was dissolved in 200 ml of anhydrous acetone. Then, 22 g of methyl p-toluene-sulfonate was added to the solution and the resultant mixture was allowed to stand overnight at 40° C. to obtain white crystals having a melting point higher than 240° C. The yield of the product was 26 g.

Elemental Analysis

| | C | H | N |
|---|---|---|---|
| Calculated: | 49.66% | 6.90% | 4.83% |
| Found: | 48.39% | 6.77% | 4.71% |

SYNTHESIS EXAMPLE 3

Synthesis of Compound 4

By following the procedure as in Synthesis Example 2, the reaction product of divinyl sulfone and dimethylamine was reacted with 15 g of allyl bromide to obtain 17.5 g of white crystals of the desired compound having a melting point higher than 240° C.

Elemental Analysis

| | C | H | N |
|---|---|---|---|
| Calculated: | 37.33% | 6.67% | 6.22% |
| Found: | 37.24% | 6.65% | 6.19% |

SYNTHESIS EXAMPLE 4

Synthesis of Compound 7

In 100 ml of absolute ethanol was dissolved 5.9 g of divinyl sulfone and 4 g of anhydrous hydrogen chloride gas was bubbled into the solution for reaction. Then, 12 g of dimethylethanolamine was added to the reaction mixture followed by stirring for 5 hours at 40° C. and then the reaction mixture was cooled to deposit white crystals, which were recovered by filtration and dried to obtain 8.7 g of the desired compound.

Elemental Analysis

| | C | H | N |
|---|---|---|---|
| Calculated: | 39.02% | 8.13% | 7.59% |
| Found: | 39.01% | 8.29% | 7.47% |

SYNTHESIS EXAMPLE 5

Synthesis of Compound 8

By following the procedure as in Synthesis Example 4, the reaction product of divinyl sulfone and hydrochloric acid was reacted with 10 g of pyridine to obtain 9 g of white crystals of the desired compound.

Elemental Analysis

| | C | H | N |
|---|---|---|---|
| Calculated: | 48.14% | 5.16% | 8.02% |
| Found: | 48.21% | 5.18% | 7.99% |

SYNTHESIS EXAMPLE 6

Synthesis of Compound 10

By following the procedure as in Synthesis Example 2, the reaction product of divinyl sulfone and dimethylamine was reacted with 15 g of propanesultone to obtain 12 g of white crystals of the desired compound.

Elemental Analysis

| | C | H | N |
|---|---|---|---|
| Calculated: | 37.17% | 7.08% | 6.19% |
| Found: | 36.94% | 7.02% | 5.93% |

It is preferred that the above-described used in this invention be coated at a coverage of greater than about $10^{-3}$ mol/m$^2$, in which this amount corresponds to an equimolar amount to or more than the amount of the primary aromatic amino color developing agent present after the initiation of the developement processing. This is because the processing composition containing the primary aromatic amino color developing agent is usually applied at the initiation of the development in such a manner that the color developing agent is present at a coverage of about $10^{-3}$ mol/m$^2$. In this case, it is more preferred that the above-described compound of this invention be coated at a coverage of from about $10^{-3}$ mol/m$^2$ to about 10 mol/m$^2$, in particular, from about $10^{-3}$ mol/m$^2$ to about 1 mol/m$^2$.

Various embodiments of using the above-described compounds in this invention will be described below in detail.

It is particularly important in this invention for the primary aromatic amino color developing agent remaining after the development is completed to be scavenged or inactivated by the compound of this invention and hence it is preferred that the compound of this invention be incorporated at a position where it can act as a scavenger of the primary aromatic amino color developing agent after the development of the photosensitive element of the photographic material is substantially finished. It is, for instance, preferred for the compound used in this invention to be incorporated in an image-receiving element and it is also effective for the compound used in this invention to be incorporated in the photosensitive element in the layer fartherest from the portion in the element at which the processing composition is distributed. Also the compound used in this invention can be incorporated in the photosensitive element as microcapsules thereof. Such microcapsules are not ruptured immediately when they are brought into contact with the processing composition and by using the molecular sieve type polymer as described in U.S. Pat. Nos. 3,421,892 and 3,625,685, the compound used in this invention can be incorporated in the photosensitive element.

When the compound of this invention is incorporated in an image-receiving element, if may, of course, be incorporated in at least one of the layers forming the image-receiving element, such as an image-receiving layer, a neutralization rate controlling layer, and a neutralizing layer. Also, an additional layer containing the compound used in this invention can be formed in the image-receiving element.

The dye image-providing material used in this invention is a non-diffusible compound which can provide a two-dimensional distribution of a diffusible dye in proportion to the exposure of light as the result of the development of the imagewise exposed silver halide emulsion layer.

The term "diffusible dye" used in this specification includes also a precursor of the diffusible dye.

The dye image-providing materials can be classified into the following typical types of materials depending on the manner of formation of diffusible dyes:

(A) Dye image-providing materials of the system wherein the oxidation by silver halide relates directly or indirectly to the provision of diffusible dyes including:

(i) dye image-providing materials whose diffusibility is changed as the result of being oxidized by silver halide, such as, for instance, a generally called dye developer which may or may not release a dye;

(ii) dye image-providing materials which release a diffusible dye by a reaction thereof with a material oxidized directly or indirectly by silver halide (e.g., an oxidized product of a developing agent); and (iii) dye image-providing materials which release a diffusible dye by reaction of the oxidized dye image-providing material with an auxiliary compound such as, e.g., a black and white developing agent.

(B) Dye image-providing materials of the system that images of diffusible dyes are formed using as the source therefor the components remaining without being consumed in the development and the subsequent reactions occurring together with the development reaction including:

(iv) dye image-providing materials of the type wherein a definite amount of a developing agent is used and the dye image-providing material present in an image-receiving layer forms a dye therein by a reaction with the developing agent which remains without being consumed in the development and is transferred into the image-receiving layer (this system may contain an oxidizing agent);

(v) dye image-providing materials of the type wherein a definite amount of a developing agent is used and the dye image-providing agent reacts with the developing agent remaining without being consumed in the development to form a diffusible dye;

(vi) dye image-providing materials of the type wherein a definite amount of a component, such as a coupler, which reacts with an oxidized product of a developing agent is used and the reactive component of the dye image-providing material remaining without being consumed in the reaction subsequent to the development (for instance, a dye moiety which was not reacted is released) is transferred into an image-receiving layer, wherein it is converted into a dye; and (vii) dye image-providing materials of the type wherein the silver ion obtained from the silver halide which was not consumed in the development is physically by colloidal silver and the dye image-providing material thus physically developed releases a diffusible dye.

(C) Dye image-providing materials which release development inhibitors including:

(viii) dye image-providing materials which release a substituent which becomes a development inhibitor from the reaction site in the coupling reaction with the oxidation product of a developing agent; and (ix) dye image-providing materials of the type wherein the dye image-providing material ozidized in the development releases a development inhibitor by a secondary reaction with a processing component such as hydroxide ion and sulfite ion.

The dye image-providing material used in the diffusion transfer color photographic system of this invention may include a completed dye structure moiety, may form a dye structure moiety in the development step and a subsequent step occurring at development, or further may form a dye in an image-receiving layer as the result of transferring a component necessary for forming the dye into the image-receiving layer.

It is desirable that the dye image-providing material used in the diffusion transfer color photographic system of this invention be non-diffusible in the photosensitive element during production, storage, and exposure of the photographic materials but the material may have various degrees of diffusibility in the steps of development and diffusion transfer depending on the system of forming dye image distributions. For instance, in one embodiment, the diffusibility of the dye image-providing material which is soluble and diffusible in a processing composition is reduced and the dye image-providing material is immobilized as the result of development and the part of the dye image-providing material which was not developed is transferred into an image-receiving material. In other embodiment, the dye image-providing material itself is non-diffusible in a processing composition and releases a diffusible dye as the result of development. Thus, it will be understood that the term "non-diffusible dye image-providing material" used in the specification and the claims of this invention includes the above-described types of the dye image-providing materials.

In the present invention the various systems of conversion into dyes during development as described above and the dye image-providing materials by various combinations of steps for forming dye structure moieties and the diffusibilities can be used but particularly useful examples of the dye image-providing materials used in this invention are as follows:

DIFFUSIBLE DYE RELEASING COUPLER

A diffusible dye releasing coupler is a reactive and non-diffusible compound which can undergo a coupling reaction with an oxidized color developing agent and can release a soluble and diffusible dye in a developing composition as the result of the coupling reaction.

The first type of compound of the diffusible dye releasing coupler contains a structure which is substituted with a group capagle of being released by an oxidized color developing agent at the coupling reaction site. The electron conjugated system of the dye to be released may be formed beforehand in the coupler or may be formed as a result of the coupling reaction.

The former type of coupler can be called an "existing type" and in this case, the coupler exhibits a spectral absorption near that of the dye to be released therefrom. On the other hand, the latter type of coupler can be called an "instantly formed type" and in this case, the coupler is in principle colorless but, as the case may be, may be colored, since if the coupler is colored, the absorption of the colored coupler does not have any direct relation to the absorption of the dye to be released therefrom.

Typical examples of diffusible dye releasing couplers which can be used in this invention can be represented by the following general formulae.

(Existing type)

$$(Cp - 1) - L - (Fr) \qquad (III)$$

(Instantly formed type)

$$(Cp - 2) - L - (Bl) \qquad (IV)$$

In the above formulae, Cp — 1 represents a coupling reactive structure moiety substituted with an (Fr) — L — moiety at the coupling position and substituted with a group, which contains a hydrophobic group having at least 8 carbon atoms and renders the coupler molecule non-diffusible, at one of the non-coupling positions and Cp — 2 represents a coupling reactive structure moiety substituted by a (Bl) — L — moiety at the coupling position. Furthermore, when the coupler is used in combination with a color developing agent which does not have a water-solubilizing group, the Cp — 2 group has a water-solubilizing group at at least one of the non-coupling positions. Also, (Fr) — L — and (Bl) — L — each represents a group which is released due to the action of an oxidized color developing agent. Fr represents a dye structure moiety (or a precursor thereof) having an absorption in a visible wavelength region or a wavelength region other than a visible wavelength region and having at least one water-solubilizing group. Bl represents a group which has a hydrophobic group of at least 8 carbon atoms and renders the coupler molecule non-diffusible.

Examples of Cp — 1 and Cp — 2 include many functional groups capable of undergoing a coupling reaction with the oxidation product of a primary aromatic amino color developing agent. For example, examples are phenols, anilines, cyclic or open chain active methylene compounds, and hydrazones. Specific examples of these useful groups are the functional groups derived from an acylamino group-substituted phenol; a 1-hydroxyl-2-naphthoic acid amide; an N,N-dialkylaniline; a 1-aryl-5-pyrazolone substituted with an alkyl group, an aryl group, an alkoxy group, an aryloxy group, an amino group, an acylamino group, a ureido group, or a sulfonamido group at the 3-position thereof; a pyrazolobenzoimidazole substituted with a group as described above; a pyrazotriazole substituted with a group as described above; an α-cyanoacetophenone substituted with a group as described above; or an α-acylacetanilide substituted with a group as described above.

Examples of the bonding group L, the bonding of which to the coupler structure moiety is cleaved by the oxidized color developing agent, are an azo group, an azoxy group, a mercuryl group (—Hg—), an oxy group, a thio group, a dithio group, a triazolyl group, a diacylamino group, an acylsulfonamino group

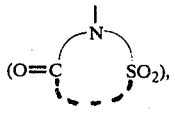

an acyloxy group, a sulfonyloxy group, and an alkylidene group. Of these groups, an oxy group, a thio group, a dithio group, a diacylamino group, and an acyloxy group which are released as anions are useful since, in this case, the efficiency of dye formation is high and a large proportion of diffusible dyes is released. For example, it is preferred for the coupling structure moiety of phenol or naphthol to be substituted through an oxy group, a thio group, or a diacyloxy group to another group or a dye structure moiety at the coupling position. On the other hand, it is preferred that a pyrazolone be substituted through an azo group, a thio group, or an acyloxy group to another group or a dye structure moiety at the coupling position and further for an acylacetanilide to be substituted through an oxy group, a thio group, or a diacylamino group to another group or a dye structure moiety at the coupling position.

Typical examples of Fr are residues derived from an azo dye, an azomethine dye, an indoaniline dye, an indophenol dye, an anthraquinone dye, a nitro dye, and an azine dye.

The hydrophobic group contained in Cp - 1 or represented by Bl contributes a cohesive force to the coupler molecules in an aqueous medium and render the couplers non-diffusible in the hydrophilic colloid forming the photographic materials.

Examples of such a hydrophobic group include aliphatic groups each having at least 8 carbon atoms (e.g., substituted or unsubstituted alkyl groups, substituted or unsubstituted alkenyl groups, and substituted or unsubstituted aralkyl groups), alkylaryl groups and alkylaryloxy groups which can be advantageously used. Typical examples of hydrophobic groups are a lauryl group, a stearyl group, an oleyl group, a 3-n-pentadecyl-phenyl group, a 2,4-di-t-amylphenoxy group, etc. The hydrophobic group may be attached to the coupling fundamental structure moiety directly or through a divalent bond such as an amido bond, a ureido bond, an ether bond, an ester bond, or a sulfonamido bond to form Cp - 1. Also, the hydrophobic group may form Bl by itself or by attachment to a group such as an aryl group and a heterocyclic group directly or through a divalent group as indicated above.

The water-solubilizing group present in Cp - 2 or Fr is an acid group which substantially dissociates in a processing composition or a precursor group which forms such an acid group upon hydrolysis. An acid group having a pKa less than about 11 is particularly useful. Examples of such an acid group are a sulfo group, a sulfoxy group (—O—$SO_3H$), a carboxy group, a sulfonamido group, a diacylamino group, a cyanosulfonamino group, and a phenolic hydroxy group.

When the diffusible dye releasing coupler of the type represented by the general formula (III) is reacted with an oxidized color developing agent, the coupler is cleaved at the bond L to form a non-diffusible condensation product of Cp - 1 and the color developing agent and also a soluble dye containing the structure moiety Fr. This soluble dye diffuses into an image-receiving layer to form a dye image.

When the diffusible dye releasing coupler of the type represented by the general formula (IV) reacts with an oxidized color developing agent, the coupler is cleaved at the bond L to form a soluble dye which is an oxidation coupling product of Cp - 2 and the color developing agent and also a non-diffusible released product derived from Bl - L -. The soluble dye diffuses into an image-receiving layer to form a dye image there.

Typical examples of diffusible dye releasing couplers of the type represented by the general formula (III) are as follows:

α-[4-(δ-Acetamido-3,6-disulfo-1-hydroxy-2-naphthylazo)-phenoxy]-α-pivalyl-4-(N-methyl-N-octadecylsulfamyl)acetanilide di-sodium salt, 1-(p-t-Butylphenoxyphenyl)-3-[α-(4-t-butylphenoxy)-propionamido]-4-(2-bromo-4-methylamino-5-sulfo-1-anthra-9,10-quinolyl-azo)-5-pyrazolone, and 1-Hydroxy-4-{3-[4-(N-ethyl-N-β-sulfoethylamino)-2-methylphenylazo]phenylazo}-N-[δ-(2,4-di-t-amylphenoxy)butyl]-2-naphthamide sodium salt.

Also, typical examples of diffusible dye releasing couplers of the type represented by the general formula (IV) are as follows:

α-(4-Methoxybenzyl)-α-(3-octadecylcarbamylphenylthio)-3,5-dicarboxyacetanilide,

α-Pivalyl-α-(3-octadecylcarbamylphenylthio)-4-sulfoacetanilide potassium salt,

1-Phenyl-3-(3,5-dicarboxyanilido)-4-(3-octadecylcarbamylphenylthio)-5-pyrazolone, 1-Phenyl-3-(3,5-disulfobenzoylamino)-5-(2-hydroxy-4-n-pentadecylphenylazo)-5-pyrazolone, 1-[4-(3,5-Dicarboxybenzamido)phenyl]-3-ethoxy-4-(3-octadecylcarbamylthio)-5-pyrazolone, 1-Hydroxy-4-(3-octadecylcarbamylphenylthio)-N-ethyl-3′,5′-dicarboxy-2-naphthanilide, and 1-Hydroxy-4-(n-octadecylsuccinimido)-N-ethyl-3′,5′-dicarboxy-2-naphthanilide.

Other examples of the diffusible dye releasing couplers which can also be used in this invention are described in British Pat. Nos. 840,731, 904,364 and 1,085,631 and U.S. Pat. Nos. 3,476,563, 3,644,498 and 3,419,391.

In the second type of diffusible dye releasing coupler, an intramolecular ring closing reaction occurs with the substituent at a position adjacent the reaction site subsequent to the condensation reaction with an oxidized color developing agent, whereby the dye residue contained in the substituent is cleaved and released therefrom. In particular, a reaction is useful in which after coupling of an oxidized primary aromatic amino color developing agent to the 4-position of phenol or aniline, an azine ring is formed with a sulfonamido group containing a dye structure moiety at the 3-position thereof to release a diffusible dye having a sulfonic acid group (e.g., the reaction described in Japanese Patent Publication No. 32129/73). Specific examples of compounds of this type are as follows:

1-Phenyl-3-ethylcarbamoyl-4-{2-methoxy-4-[N,N-dodecyl-N-(1-hydroxy-4-chloro-3-naphthyl)]sulfamylphenylazo}-5-pyrazolone, 2-(β-Octadecylcarbamoylethyl)-4-{2-[4-(2-hydroxy-1-naphthyl-azo)phenylsulfonamido]anilino}phenol, etc.

Furthermore, another example of the dye image-providing material which forms a diffusible dye by reaction with a primary aromatic amino color developing agent is shown by the general formula (V):

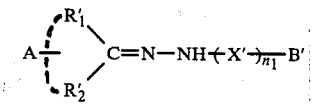

(V)

wherein $R_1'$ represents a hydrogen atom, an alkyl group (preferably having up to 20 carbon atoms), an allyl group, an aralkyl group, or an amino group (substituted with an alkyl or aryl group); $R_2'$ represents an alkyl group (preferably having up to 20 carbon atoms), an aralkyl group, an aryl group, an acyl group derived from an aliphatic carboxylic acid (preferably having up to 20 carbon atoms), an aromatic carboxylic acid, or an amino group (substituted with an alkyl or aryl group); and $R_1'$ and $R_2'$ may combine with each other to form a heterocyclic ring such as, for instance, a ring containing an azole nucleus which may contain a hetero atom such as a nitrogen, sulfur, oxygen, or selenium atom; X' represents a sulfonyl group or a carbonyl group; $n_1$ is 0 or 1; A represents a group which is photographically inert and renders the dye image-providing material non-diffusible; and B' represents a dye (or a precursor thereof); or A represents a dye moiety (or a precursor thereof) or an atomic group capable of forming the dye or a precursor thereof with $R_2'$ and B' represents a group which is photographically inert and renders the dye image-providing material non-diffusible.

Still another example of a dye image-providing material which can be used in this invention is represented by the general formula (VI):

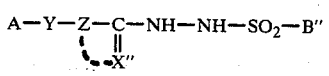

(VI)

wherein A represents a dye moiety (or a precursor thereof) and B'' represents, in this case, an aliphatic or aromatic hydrophobic group (ballasting group) or alternatively A' represents an aliphatic or aromatic hydrophobic group and B'' represents, in this case, a dye moiety (or a precursor thereof); X'' represents an oxygen atom, a sulfur atom, or an imino group; Y represents —O—, —S—, —NR—, —CO—, —$SO_2$—, —$SO_2$NR—, or —CONR— (wherein R represents a hydrogen atom or an alkyl group); and Z represents a chemical bond between the carbon atom attached to X'' and Y, or an atomic group necessary for a 5-membered or 6-membered nitrogen-containing heterocyclic ring together with the carbon atom attached to X'' and Y.

These compounds are specifically described in British Patent No. 1,321,046 and Japanese Patent Application (OPI) No. 64436/74.

As the color developing agent used in combination with the diffusible dye releasing coupler, primary aromatic amino color developing agents, p-aminophenols, and p-phenylenediamines are advantageously used. These compounds can have a substituent such as a halogen (e.g., chlorine, bromine, etc.), an aliphatic group (e.g., an alkyl group, etc.), a substituted alkyl group (substituted with a sulfo group, a carboxy group, a hydroxy group, an amido group, etc.), an acetamido group, an alkoxy group (such as a methoxy group, a hydroxypropoxy group, a propoxy group, etc.), etc. Typical examples are 2-chloro-4-aminophenol, 2,6-dichloro-4-aminophenol, 4-amino-N,N-diethyl-3-methylaniline, N,N-diethyl-p-phenylenediamine, N-ethyl-β-methanesulfonamidoethyl-3-methyl-4-aminoaniline, 4-amino-N-ethyl-N-(δ-sulfobutyl)-aniline, 4-amino-N-ethyl-N-(δ-hydroxyethyl)aniline, 4-amino-3-methyl-N-ethyl-N-(β-hydroxyethyl)aniline, 4-amino-N-ethyl-N-(β-carboxyethyl)aniline, 4-amino-N,N-bis(β-hydroxyethyl)-3-methylaniline, 3-acetamido-4-amino-N,N-(β-hydroxyethyl)aniline, 4-amino-N-ethyl-N-(2,4-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline, and the hydrochlorides, sulfates, oxalates, p-toluenesulfonates, etc., of these anilines. These color developing agents are, in general, incorporated into the processing composition or the image-receiving element, preferably in the processing composition, of the photographic material.

Moreover, the Schiff bases of these anilines, the imides as described in British Pat. Nos. 775,692, 803,783, and 1,069,061; the precursors of developing agents such as the derivatives as described in U.S. Pat. No. 3,342,597 and British Pat. No. 1,001,473; and the sparingly soluble salts of developing agents as described in U.S. Pat. No. 3,719,492 can be advantageously used as the color developing agent used in this invention since they can be incorporated into photosensitive elements of the photographic materials of this invention.

The negative type silver halide emulsion layer containing the diffusible dye releasing coupler provides a negative diffusion-transferred dye image in an image-receiving element on development processing. On the other hand, the direct positive type silver halide emulsion layer containing the diffusible dye releasing coupler provides a positive diffusion-transferred dye image. As such a direct positive silver halide emulsion, the internal latent image type silver halide emulsions as described in U.S. Pat. Nos. 2,592,350, 2,588,982 and 3,227,552 and the fogged type silver halide emulsions as described in British Pat. Nos. 443,245 and 462,730 and U.S. Pat. Nos. 2,005,837, 2,541,472 and 3,367,778 can be advantageously used.

Moreover, a positive diffusion-transferred dye image is also obtained by processing a layer containing the diffusible dye releasing coupler and physical development centers adjacent a negative type silver halide emulsion layer with a developer containing a silver halide solvent. The techniques described in German Patent Application (OLS) No. 2,136,994 and British Pat. No. 904,364 can be utilized as the reversal dye image-forming technique using physical developing centers. Furthermore, a photosensitive element including a negative type silver halide emulsion layer containing a compound which releases a development inhibitor such as 1-phenyl-5-mercaptotetrazole on reaction with the oxidation product of a color developing agent (referred to as DIR compound) and a layer containing the diffusible dye releasing coupler and a spontaneously reducible metal salt disposed adjacent the silver halide emulsion layer also provides a negative diffusion-transferred dye image as disclosed in U.S. Pat. Nos. 3,227,551, 3,227,554 and 3,364,022 and German Pat. Application (OLS) No. 2,032,711. The present invention can be employed in a system including the combination of silver halide emulsions and dye image-providing materials and in this case the system of providing negative dye images or the system of providing positive dye images can be employed selectively depending on the end-use purposes.

The development inhibitor-releasing compound (so-called DIR compound) which can be used in this invention is a compound capable of imagewise providing a development inhibitor on development, such as (1) a coupler capable of releasing a substituent at the reaction site which becomes a development inhibitor due to the coupling reaction with the oxidation product of a primary aromatic amino color developing agent and (2) a compound capable of releasing a development inhibitor due to a secondary reaction of a compound oxidized in the development and a processing component such as hydroxide ion and sulfite ion.

The DIR compound which can be used in this invention must contain a hydrophobic residue having at least 8 carbon atoms in the molecule and be rendered non-diffusible. The hydrophobic residues used for ordinary non-diffusible couplers can be utilized as the hydrophobic residues in the DIR compound.

The releasable group of the DIR compound which can be used in this invention can have a chemical structure exhibiting a development inhibiting effect before it is released from the compound or may complete development an inhibiting chemical structure after release. Useful development inhibitors include iodine ions, alkylmercaptans, arylmercaptans, heterocyclic mercaptans, triazoles, imidazoles, purine nucleus compounds, etc., and further examples of the development inhibitors having particularly high development inhibiting effects are mercapto-triazoles, mercaptotetrazoles, mercaptopyrimidines, mercapto-thiazines, mercaptooxazoles, mercaptoimidazoles, mercapto-thiazoles, and benzotriazoles. Specific examples of development inhibitors and 4-nitrothiophenol, 2-ethoxycarbonylthiophenol, 1-phenyl-5-mercaptotetrazole, 2-mercaptobenzothiazole, 2-mercapto-4,6,6-trimethylpyrimidine, 5-bromobenzatriazole, etc.

It is preferred in order not to prevent the unexposed portion from being developed for the development inhibitor to be introduced in the reactive position of the DIR compound through a chemical bond for blocking the development inhibiting center (e.g., an iodine-carbon bond, a thioether bond, and an N-triazole group-carbon bond) rather than for the development inhibitor to be introduced into the DIR compound with a structure capable of exhibiting a development inhibiting action. The DIR couplers which can advantageously be used in this invention are couplers providing colored coupling products and development inhibitors as described in U.S. Pat. Nos. 3,148,062, 3,227,550, 3,227,551, 3,227,554 and 3,617,291 and the couplers providing colorless coupling products and development inhibitors as described in U.S. Pat. No. 3,632,345.

Typical examples of the preferred DIR couplers which can be used in this invention are shown below:

DIR Y-1

α-Pivaloyl-α-(1-phenyl-5-tetrazolylthio)-2-chloro-5-[γ-(2,4-di-t-amylphenoxy)butyramido]acetanilide

DIR Y-2

α-(4-Methoxybenzyl)-α-(1-phenyl-5-tetrazolylthio)-2-chloro-5-[α-(2,4-di-t-amylphenoxy)-butyramido]acetanilide

DIR Y-3

α-Benzoyl-α-(1-phenyl-5-tetrazolylthio)aceto-2-methoxy-5-n-tetradecyloxycarbonylanilide

DIR Y-4

α-(p-n-Octadecyloxybenzoyl)-α-(5- or 6-bromobenzo-1-benzatriazolyl)aceto-2-methoxyanilide

DIR M-1

1-{4-[α-(2,4-di-t-Amylphenoxy)butyramido]phenyl}-3-(1-piperidino)-4-(1-phenyl-5-tetrazolylthio)-5-pyrazolone

DIR M-2

4-(2-Benzotriazolyl)-1-(2,4,6-trichlorophenyl)-3-{3-[α-(2,4-di-t-amylphenoxy)acetamido]benzamido}-5-pyrazolone

DIR M-3

1-Benzyl-3-(3-myristoylamino-4-methoxy)-4-(5-bromobenzotriazole-1)-5-pyrazolone.

DIR C-1

1-Hydroxy-4-(1-phenyl-5-tetrazolylthio)-N-[γ-(2,4-di-t-amylphenoxy)propyl]-2-naphthamide

DIR C-2

1-Hydroxy-4-(2-nitrophenylthio)-N-octadecyl-3',5'-dicarboxy-2-naphthanilide

DIR C-3

1-Hydroxy-4-(1-phenyl-5-tetrazolylthio)-N-(2-chloro-5-n-tetradecyloxycarbonylphenyl)-2-naphthamide

DIR C-4

1-Hydroxy-4-(1-phenyl-5-tetrazolylthio)-N-(2-tetradecyl-oxyphenyl)-2-naphthamide

DIR U-1

α-(1-Phenyl-5-tetrazolylthio)-2-sulfo-4-n-hexadecyloxy-acetophenone potassium salt Also, the DIR hydroquinones nucleus-substituted with development inhibitor groups as described in U.S. Pat. Nos. 3,297,445, 3,364,022, and 3,379,529 can also be advantageously used in this invention as DIR compounds. These DIR hydroquinones release development inhibitors due to the action of nucleophilic components such as hydroxide ions, sulfite ions, etc., in a processing composition. Typical examples of preferred DIR hydroquinone derivatives are as follows:

DIR H-1

2-t-Octyl-5-(1-phenyl-5-tetrazolylthio)hydroquinone

DIR H-2

2-n-Pentadecyl-5-(1-phenyl-5-tetrazolylthio)hydroquinone

DIR H-3

2-n-Octadecylthio-5-(1-phenyl-5-tetrazolylthio)-hydroquinone

DIR H-4

3-n-Octadecylthio-5-phenylthio-6-(1-phenyl-5-tetrazolylthio)hydroquinone

Other various dye image-providing materials can also be employed in this invention in addition to the above-described dye image-providing materials. That is, the dye image-providing materials which can be used in this invention are described in, for instance, the specifications of U.S. Pat. Nos. 3,628,952, 3,839,035, 3,844,785, 3,192,045, 3,725,062, 3,698,897, 3,728,113, 3,765,886, 3,734,726, 3,813,244, 3,359,104, 3,837,852, 3,245,789, 3,443,943, 3,449,941, 3,537,852, 3,537,851, 3,537,870, 3,658,524, 3,719,488 and 3,719,489 and British Pat. Nos. 840,731, 904,364, 1,157,505, 1,157,506, 1,157,503 and 1,157,504 and German Patent Application (OLS) Nos. 1,930,215, 2,317,134, 1,153,248 2,242,762, 2,402,900, 2,406,653 and 2,406,626 and Japanese Patent Application (OPI) Nos. 2327/72, 114424/74, 32129/73, 15533/73, 10035/74, 123032/74 and 15532/73.

The dye image-providing material used in the present invention can be dispersed in a carrier, a hydrophilic colloid, according to various methods depending upon the type of the dye image-providing material. For example, compounds having a dissociative group such as a sulfo group or a carboxy group such as diffusible dye-releasing couplers can be added to a hydrophilic colloid solution after being dissolved in water or in an alkaline aqueous solution. With dye image-providing materials which are slightly soluble in an aqueous medium and readily soluble in an organic solvent, they are first dissolved in an organic solvent, and then the resulting solution is added to a hydrophilic colloid solution, followed by stirring or the like to disperse the solution as fine particles. Suitable solvents which can be used are ethyl acetate, tetrahydrofuran, methyl ethyl ketone, cyclohexanone, $\beta$-butoxy-$\beta$-ethoxyethyl acetate, dimethylformamide, dimethylsulfoxide, 2-methoxyethanol, tri-n-butylphthalate, etc. Of these dispersion solvents, those solvents which possess comparatively high vapor pressures can be vaporized upon drying of the photographic layers, or can be vaporized according to the method described in U.S. Pat. Nos. 2,322,027 and 2,801,171 prior to coating. Of these dispersion solvents, those solvents which are readily soluble in water can be removed by washing with water according to U.S. Pat. Nos. 2,949,360 and 3,396,027.

In order to stabilize the dispersion of the dye image-providing material and accelerate the dye image-forming step, it is advantageous to incorporate, in a light-sensitive element, a solvent which is substantially insoluble in water and has a boiling point of not less than about 200° C. under ordinary pressure together with the dye image-providing material. High boiling solvents suitable for this purpose include fatty acid esters such as triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyllaurylamide; hydroxy compounds such as 2,4-di-n-amylphenol; and the like. Furthermore, in order to stabilize the dispersion of dye image-providing material and to accelerate the step of dye image formation, it is advantageous to incorporate in a light-sensitive element a polymer having affinity for the solvent together with the dye image-providing material. Polymers having affinity for the solvent and suitable for this purpose include shellac, phenol-formaldehyde condensates, poly-n-butyl acrylate, n-butyl acrylate-acrylic acid copolymers, ethylene glycol-propylene glycol-adipic acid polyesters; ethylene glycol-propylene glycol-adipic acid copolymers; n-butyl acrylate-styrene-methacrylamide copolymers, and the like. These polymers can be dissolved in an organic solution together with the dye image-providing material and then dispersed in a hydrophilic colloid, or can be added, as a hydrosol prepared by emulsion polymerization or the like, to a hydrophilic colloid dispersion of the dye image-providing material.

In general, the dispersion of the dye image-providing material can be effectively conducted under great shearing force. For example, a high speed rotary mixer, a colloid mill, a high pressure milk homogenizer, a high pressure homogenizer as described in British Pat. No. 1,304,264, an ultrasonic emulsifying apparatus, and the like are useful. The use of a surface active agent as an emulsifying aid markedly helps to disperse the dye image-providing material. Surface active agents useful for the dispersion of the dye image-providing material used in the present invention include sodium triisopropylnaphthalenesulfonate, sodium dinonylnaphthalenesulfonate, sodium p-dodecylbenzene-sulfonate, dioctyl sulfosuccinate sodium salt, sodium cetylsulfate and the anionic surface active agents described in Japanese Patent Publication No. 4293/64. The combined use of these anionic surface active agents and higher fatty acid esters of anhydrohexitol exhibits a particularly good emulsifying ability as described in U.S. Pat. No. 3,676,141.

The silver halide emulsion used in the present invention is a colloidal dispersion of a silver halide such as silver chloride, silver bromide, silver chlorobromide, silver bromoiodide, silver chlorobromoiodide or a mixture thereof. The halide composition is selected depending upon the end-use purposes of the light-sensitive material and the processing conditions. In particular, a silver bromoiodide emulsion or silver chlorobromoiodide emulsion containing about 1 mol% to about 10 mol% iodide, not more than about 30 mol% chloride and the balance bromide is desirable. Useful silver halide grains have a mean grain size of about 1.0$\mu$ to about 2$\mu$. For some end-use purposes of the light-sensitive material, silver halides having a uniform grain size are desirable. The grains can be in a cubic form, an octahedral form or in a mixed crystal form. These silver halide emulsions can be prepared according to known conventional processes, e.g., as described in P. Glafkides, *Chimie Photographique* 2nd Ed., Chapters 18 to 23, Paul Montel, Paris (1957). That is, a water-soluble silver salt such as silver nitrate and a water-soluble halide such as potassium bromide are reacted with each other in the presence of a solution of a protective colloid such as gelatin and crystals are allowed to develop in the presence of excess halide or a silver halide solvent such as ammonia. In this occasion, a single or double jet method or a pAg-controlled double jet method can be employed as the precipitating method. Removal of the soluble salts from the emulsion can be effected by washing and dialysis of the cool-set emulsion, by a combination of the addition of a sedimenting agent such as an anionic polymer containing sulfone groups, sulfuric ester groups or carboxy groups or an anionic surface active agent and the adjustment of the pH, or by a combination of the use of an acylated protein such as phthaloyl gelatin as a protective colloid and the adjustment of the pH, to thereby cause sedimentation.

The silver halide emulsions which are used in the present invention are preferably subjected to a chemical sensitization by a heat-treatment using the natural sensitizers contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylenetetramine. Also, emulsions which tend to form a latent image on the surface of the silver halide grains and emulsions which tend to form a latent image inside the silver halide grains as described in U.S. Pat. Nos. 2,592,550, 3,206,313, etc., can be used in the present invention.

The silver halide emulsions which can be used in the present invention can be stabilized by incorporation therein of additives such as 4-hydroxy-6-methyl-1,3,3*a*,7-tetrazaindene, 5-nitroimidazole, 1-phenyl-5-mercaptotetrazole, 8-chloromercuriquinoline, 2-mercapto-5-sulfobenzimidazole, benzenesulfinic acid, pyrocatechin, 4-methyl-3-sulfoethylthiazolidine, 4-phenyl-3-sulfoethylthiazolidine-2-thione, etc. In addition, inorganic compounds such as cadmium salts, mercury salts, complex salts of platinum group metals such as the chloro complex salt of palladium, and the like are also useful for stabilizing the light-sensitive material of the present invention. Furthermore, the silver halide emulsions to be used in the present invention can contain sensitizing compounds such as a polyethylene oxide compound.

The silver halide emulsions in the present invention can possess, if desired, a color sensitivity expanded with optical sensitizing dyes. Useful optical sensitizing agents include cyanines, merocyanines, holopolar cyanines, styryls, hemicyanines, oxanols, hemioxanols, and the like. Specific examples of optical sensitizing agents are described in P. Glafkides, supra, Chapters 35 to 41, and F. M. Hamer, *The Cyanine Dyes and Related Compounds* (Interscience). In particular, cyanine compounds in which a nuclear nitrogen atom is substituted with an aliphatic group having a hydroxy group, a carboxy group or a sulfo group, e.g., those described in U.S. Pat. Nos. 2,503,776, 3,459,553, and 3,177,210, are especially useful for the practice of the present invention.

The processing solution permeable layers to be used in the invention such as the silver halide emulsion layer, the dye image-providing material-containing layer and the auxiliary layers (e.g., a protective layer, an interlayer, etc.) contain a hydrophilic polymer as a binder. Suitable hydrophilic polymers are gelatin, casein, gelatin modified with an acylating agent or the like, vinyl polymer-grafted gelatin, proteins such as albumin, cellulose derivatives such as hydroxyethyl cellulose, methyl cellulose, carboxymethyl cellulose, etc., polyvinyl alcohol, partially hydrolyzed products of polyvinyl acetate, polyvinyl pyrrolidone, high molecular weight non-electrolytes such as polyacrylamide, polyacrylic acid, partially hydrolyzed products of polyacrylamide, anionic synthetic polymers such as vinyl methyl ether-maleic acid copolymers, N-vinylimidazoleacrylic acid-acrylamide copolymers and, synthetic polymer amphoteric electrolytes such as polyacrylamide having been subjected to the Hoffman reaction. These hydrophilic polymers can be used individually or in combination. Furthermore, these hydrophilic polymer layers can contain a latex-like polymer dispersion of hydrophobic monomers such as alkyl acrylates, alkyl methacrylates, etc. These hydrophilic polymers, particularly, polymers having functional groups such as amino groups, hydroxy groups or carboxy groups can be rendered insoluble with various cross-linking agents without loss of processing solution permeability. Particularly useful cross-linking agents include aldehyde compounds such as formaldehyde, glyoxal, glutaraldehyde, mucochloric acid, acrolein oligomer, etc.; aziridine compounds such as triethylenephosphoramide described in Japanese Patent Publication No. 8790/62; epoxy compounds such as 1,4-bis(2',3'-epoxypropoxy)diethyl ether described in Japanese Patent Publication No. 7133/59; active halogen compounds such as 2-hydroxy-4,6-dichloro-s-triazine sodium salt; active olefin compounds such as hexahydro-1,3,5-triacryl-s-triazine; methylol compounds such as N-polymethylol urea, hexamethylol melamine, etc.; high molecular weight compounds such as dialdehyde starch or 3-hydroxy-5-chloro-s-triazinyl gelatin, described in U.S. Pat. No. 3,362,837, etc. These hydrophilic polymers can contain a cross-linking-accelerating agent such as a carbonate or resorcin as well as the cross-linking agent.

The photographic layers used in the present invention can be coated using various coating methods such as a dip coating method, a roller coating method, an air knife coating method, a bead coating method described in U.S. Pat. No. 2,681,294, a curtain coating method described in U.S. Pat. Nos. 3,508,947 and 3,513,017, etc. In particular, with light-sensitive elements of a multilayered structure, it is convenient to coat a number of layers at the same time using a multislit hopper described in U.S. Pat. Nos. 2,761,417, 2,761,418, 2,761,419 and 2,761,791. A suitable amount of silver halide in each emulsion layer coated ranges from about 0.001 to 0.2 mol/m$^2$ of the support.

In order to facilitate the coating of the photographic layers used in the present invention, the coating compositions advantageously contain various surface active agent as a coating aid. Useful coating aids include nonionic surface active agents such as saponin, p-nonylphenol ethylene oxide adducts, alkyl ethers of sucrose, glycerin monoalkyl ethers, etc., anionic surface active agents such as sodium dodecylsulfate, sodium p-dodecylbenzenesulfonate, dioctylsulfosuccinate sodium salt, etc., and amphoteric surface active agents such as carboxymethyl-dimethyllaurylammonium hydroxide inner salt, "Deriphat 151", trade name of the General Mills Co., betaine compounds described in U.S. Pat. No. 3,441,413, British Pat. No. 1,159,825 and Japanese Patent Publication No. 21985/71, etc.

In order to facilitate the coating of the photographic layers used in the present invention, the coating composition can contain various thickening agents. For example, in addition to those agents which increase the viscosity of the coating composition due to their own viscosity such as high molecular weight polyacrylamide, anionic polymers such as cellulose sulfate, poly-p-sulfostyrene potassium salt and acrylic polymers described in U.S. Pat. No. 3,655,407 which exhibit a thickening action due to a mutual interaction with a binder polymer contained in the coating composition are similarly useful.

The processing composition used in the present invention is a liquid composition containing the processing components necessary for the development of the silver halide emulsion and necessary for the formation of diffusion transferred dye image. The main solvent therein is water and, in some cases, a hydrophilic solvent such as methanol or methyl Cellosolve can be additionally present. The processing composition contains alkali in an amount sufficient to maintain the pH at a level necessary to cause the development of the emulsion layer and to neutralize the acids produced during the various steps of development and dye image formation. Examples of alkalis which can be used include sodium hydroxide, potassium hydroxide, calcium hydroxide dispersion, tetramethylammonium hydroxide, sodium carbonate, trisodium phosphate, diethylamine, etc. The processing composition preferably has a pH of not less than about 12 at room temperature (e.g., about 20°-30° C). More preferably, the processing composition contains a hydrophilic polymer such as a high molecular weight polyvinyl alcohol, hydroxyethyl cellulose, sodium carboxymethyl cellulose or the like. These polymers impart to the processing composition a viscosity of not less than about 1 poise, preferably about 1,000 poise, at room temperature, which not only facilitates the uniform spreading of the processing composition on processing but also the formation of an immovable film, upon concentration of the processing composition due to the migration of the aqueous solvent into the light-sensitive element and the image-receiving element during the course of the processing, thus serving to unify the film unit after processing. In addition, this polymer film can serve, after the substantial completion of the formation of the diffusion transferred dye image, to control a further migration of the coloring components into the image-receiving layer, thereby preventing the image from being changed.

In some cases, the processing composition advantageously contains a light absorbent such as carbon black and a desensitizer as described in U.S. Pat. No. 3,579,333 to prevent the silver halide emulsion from being fogged by ambient light during processing, e.g., outside a camera. Furthermore, the processing composition advantageously contains processing ingredients specific to the dye image-providing material used. When dye developers are used as the dye image-providing material, auxiliary developing agents such as p-aminophenol, 4'-methylphenylhydroquinone, 1-phenyl-3-pyrazolidone, etc., an onium development accelerator such as N-benzyl-α-picolinium bromide, and an anti-fogging agent such as benzotriazole are the examples of such components and, when diffusible dye-releasing couplers are used as a dye image-providing material, developing agents such as an aromatic primary amino color developing agent, an antioxidizing agent such as a sulfite or ascorbic acid, and anti-fogging agent such as a halide or 5-nitro-benzimidazole, a silver halide solvent such as thiosulfate or uracil are examples of such components.

The processing composition used in the present invention is advantageously retained in a pressure rupturable container. Such a container is advantageously prepared by folding a sheet of a liquid and air-impervious material and sealing each edge to form a cavity in which the processing composition is to be retained, and the container is advantageously constituted so that, when the unit is passed through pressure-applying members, the container is ruptured at a given point due to the inner hydraulic pressure generated within the processing composition to thereby release the contents. A polyethylene terephthalate/polyvinyl alcohol/polyethylene laminate, a lead foil/vinyl-chloride-vinyl acetate copolymer laminate or the like can be advantageously used as the material for forming the container. This container is desirably fixedly positioned and extends transverse a leading edge of the film unit (i.e., in the direction of travel of the photographic material with respect to the pressure applying means) to effect a substantially unidirectional discharge of the contents of the container on the surface of the light-sensitive element. Preferred examples of such containers are described in U.S. Pat. Nos. 2,543,188, 2,643,886, 2,653,732, 2,723,051, 3,056,491, 3,056,492 and 3,152,515. These containers are advantageous for the practice of the present invention.

The image-receiving element used in the invention fixes the dye-image-forming materials such as the diffusible dyes, etc., which are released in an imagewise distribution from the dye image-providing materials associated with the silver halide emulsion. Where dye developers having a hydroquinonyl group or anionic material such as color dyes having an acidic water-solubilizing group are used as the dye image-forming material, the image-receiving element preferably contains a basic polymer or a basic surface active agent. As basic polymers those which contain tertiary or quaternary nitrogen atoms are excellent. More specifically, illustrative examples include poly-4-vinyl-pyridine, a polymer of the aminoguanidine derivative of vinyl methyl ketone described in U.S. Pat. No. 2,882,156, poly-4-vinyl-N-benzylpyridinium p-toluenesulfonate, poly-3-vinyl-4-methyl-N-n-butylpyridinium bromide, styrene/N-(3-maleimidopropyl)-N,N-dimethyl-N-4-phenylbenzylammonium chloride copolymer described in British Pat. No. 1,261,925, poly[N-(2-methacryloylethyl)-N,N-dimethyl-N-benzylammonium]chloride, etc. As basic surface active agents, those which possess an onium residue such as an ammonium, sulfonium or phosphonium residue and possess a hydrophobic residue such as a long-chain alkyl group are excellent. More specifically, examples include N-laurylpyridinium bromide, cetyltrimethylammonium bromide, methyl-tri-n-laurylammonium p-toluenesulfonate, methyl-ethyl-cetylsulfonium iodide, benzyl-triphenylphosphonium chloride, etc. In addition to these basic compounds, multivalent metals such as thorium, aluminum, zirconium, etc., also exert a fixing action on anionic dye-forming materials. These substances advantageously form films together with polymers such as gelatin (in particular, acid-processed gelatin), polyvinyl alcohol, polyacrylamide, polyvinyl methyl ether, hydroxyethyl cellulose, N-methoxymethylpolyhexylmethyleneadipamide, polyvinylpyrrolidone, etc.

Where the dye image-forming material is one component for forming a dye like a diffusible coupler, the image-receiving layer contains another coupling component capable of reacting with this component to form a dye, such as a p-phenylenediamine derivative and an oxidizing agent, or a diazonium compound. This type of image-receiving element is described in U.S. Pat. Nos. 2,647,049, 2,661,293, 2,698,244, 2,698,798, 2,802,735, 3,676,124, British Pat. Nos. 1,158,440, 1,157,507, etc. The image-receiving layer, suitably, has a thickness of about 2μ to 30 μ.

the diffusion transfer photographic material of the present invention preferably possesses the function of neutralizing the alkali brought thereinto from the processing composition. The processing composition contains alkali so as to provide a pH of higher than about 10, preferably higher than 11, which is sufficiently high to accelerate the image-forming steps comprising the development of the silver halide emulsion and the formation and diffusion of the diffusible dye image-forming material. After the substantial completion of the formation of the diffusion transferred images, the pH in the photographic material is reduced to around neutrality, i.e., less than about 9, preferably less than 8, whereby further image-formation is actually discontinued to prevent the image tone from being changed with the lapse of time and to control discoloration and fading of the images and stain of the white background due to high alkalinity. For this purpose, it is advantageous to provide in the photographic material a neutralizing layer containing an acidic substance in a sufficient quantity to neutralize the alkali contained in the processing composition to the above-described pH, that is, in an area concentration equivalent to or more than the amount of the alkali contained in the spread processing composition. Preferred acidic substances are those which contain an acidic group having a pKa of less than about 9, particularly a carboxy group or a sulfonic acid group, or contain a precursor group capable of providing such an acidic group upon hydrolysis. More preferred examples are higher fatty acids such as oleic acid described in U.S. Pat. No. 2,983,606, polymers of acrylic acid, methacrylic acid or maleic acid, the partially esterified polymers of maleic acid, or of maleic acid anhydrides. Specific examples of high molecular weight acidic materials are copolymers of a vinyl monomer (e.g., ethylene, vinyl acetate, vinyl methyl ether, etc.) and maleic anhydride, and the n-butyl half ester thereof; copolymers of butyl acrylate and acrylic acid; cellulose acetate hydrogen phthalate; and the like. In addition to these acidic materials the neutralizing layer can contain polymers such as cellulose nitrate and polyvinyl acetate, and a plasticizer as described in U.S. Pat. No. 3,557,237. Furthermore, the neutralizing layer can be hardened through a cross-linking reaction with a multifunctional aziridine compound, epoxy compound, etc. The neutralizing layer can be positioned in the image-receiving element and/or the light-sensitive element. In particular, the neutralizing layer is advantageously positioned between the support of the image-receiving element and the image-receiving layer. As described in German Patent Application (OLS) No. 2,038,254, the acidic substances can be microencapsulated for incorporation in the photographic material.

The neutralizing layer or the acidic substance-containing layer, whose thickness, in general, ranges about 5μ to 50μ, used in the present invention is desirably separated from the spread processing composition layer by a neutralization rate-controlling (or timing) layer. This timing layer functions to prevent an undesirable reduction in the transfer image density due to a too fast reduction in the pH before the necessary development of the silver halide emulsion layer and the formation of the diffusion transfer image are completed. That is, the timing layer functions to delay the reduction in pH until necessary development and transfer are completed. In a preferred embodiment of the present invention, the image-receiving element possesses a multilayered structure comprising a support—a neutralizing layer—a timing layer—a mordant layer (image-receiving layer) in this sequence. The timing layer comprises mainly ploymers such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, copolymers of β-hydroxyethyl methacrylate and ethyl acrylate, and the like. These polymers can be advantageously hardened through a cross-linking reaction with an aldehyde compound such as formaldehyde or an N-methylol compound. The timing layer preferably has a thickness of about 2μ to 20μ.

In the light-sensitive element used in the present invention, a non-diffusible dye image-providing material is associated with a silver halide emulsion. The combination of the color sensitivity of the silver halide emulsion and the spectral absorption of the dye image is appropriately selected depending upon the intended color reproduction. In the reproduction of natural colors according to subtractive color photography, a light-sensitive element having at least two combinations of silver halide emulsions, each having a selective spectral sensitivity in a certain wavelength region with compounds capable of providing images having a selective spectral absorption in the same wavelength region, is used. In particular, a light-sensitive element having a combination of a blue-sensitive silver halide emulsion with a compound capable of providing a yellow dye image, the combination of a green-sensitive silver halide emulsion with a compound capable of providing a magenta dye image, and the combination of a red-sensitive sliver halide emulsion with a compound capable of providing a cyan dye image is useful. In the light-sensitive element, these combination units of silver halide emulsions and dye image-providing materials are coated as layers in a face-to-face alignment or coated by forming each into particles and mixing the particles. In a preferred multi-layered structure, a blue-sensitive silver halide emulsion, a green-sensitive silver halide emulsion and a red-sensitive silver halide emulsion are positioned in sequence on a support from the side to be exposed to incident light. In particular, in the case of high speed emulsions containing silver iodide, a yellow filter layer can be positioned between the blue-sensitive silver halide emulsion and the green-sensitive silver halide emulsion. This yellow filter layer can contain a yellow colloidal silver dispersion, an oil-soluble yellow dye dispersion, an acidic dye mordanted with a basic polymer, or a basic dye mordanted with an acidic polymer. The emulsion layers are advantageously separated from each other by an interlayer. The interlayer prevents unfavorable mutual interactions from occurring between emulsion layer units having different color sensitivities. The interlayer can comprise a polymer containing fine pores formed by a latex of a hydrophilic polymer and a hydrophobic polymer, described in U.S. Pat. No. 3,625,685, or a polymer whose hydrophilicity is gradually increased by the processing composition, such as calcium alginate, described in U.S. Pat. No. 3,384,483, as well as a hydrophilic polymer such as gelatin, polyacrylamide, partially hydrolyzed products of polyvinyl acetate, etc. The interlayer can contain an interlayer mutual interaction-controlling agent selected depending upon the type of the dye image-providing material and the processing composition used. For example, with a dye image-providing material of the type which releases a diffusible dye due to the action of the oxidation product of a developing agent, reducing agents such as ballasted hydroquinone derivatives and ballasted couplers capable of reacting with the oxidation product to fix it are effective for preventing a disadvantageous interchange of the oxidation product of a developing agent between emulsion layer units. Furthermore, in order to attain good color reproduction, it is useful, in a system wherein image reversion is effected by a dissolution-physical development process, to further incorporate in the interlayer physical development nuclei such as a metallic silver colloid and, in a system wherein image reversion is effected using a development inhibitor-releasing (DIR) compound, it is useful to incorporate silver halide grains having a low sensitivity and a fine size in the interlayer.

The support which can be used in the present invention is a substantially planar material which does not undergo any serious dimensional change due to contact with the processing composition during processing. For some purposes, rigid supports such as glass plate can be used. However, in general, flexible supports are useful. Suitable flexible supports which can be advantageously used are those generally used for photographic light-sensitive materials, such as a cellulose nitrate film, a cellulose acetate film, a polyvinylacetal film, a polystyrene film, a polyethylene terephthalate film, a polycarbonate film, etc. Supports having dimensional stability and oxygen impermeability such as a laminate in which a polyvinyl alcohol layer is sandwiched between polyethylene terephthalate layers or between cellulose acetate layers is particularly desirable since it serves to provide stable images and less stains occur. In order to help moisture contained in the spread processing composition evaporate through the support after processing, it is advantageous to use an aqueous vapor permeable support such as is described in U.S. Pat. No. 3,573,044. In order to prevent incident light leakage through the edge of the transparent support to the silver halide emulsion layer during processing of film unit in a bright place, the transparent support is desirably colored to an extent such that the transmission of light in a plane direction to the support can be prevented without inhibiting imagewise exposure and observation therethrough. If desired, the support can contain a plasticizing agent such as a phosphoric ester, a phthalic ester, etc., an ultraviolet-absorbing agent such as 2-(2-hydroxy-4-t-butylphenyl)benzotriazole, etc., an antioxidant such as a hindered phenol, etc. In order to achieve good adhesion between the support and the hydrophilic polymer-containing layer, it is advantageous to provide a subbing layer or to subject the surface of the support to a preliminary treatment such as a corona discharge, an irradiation with ultraviolet light or a flame treatment. The support usually has a thickness of about 20 to 300μ.

In one preferred embodiment of the present invention, the image-receiving layer is positioned between the transparent support and the processing composition-permeable light-reflecting layer. With this arrangement, dye images formed by the photographic processing can be viewed through the transparent support, and hence it is not necessary to separate the light-sensitive element from the image-receiving element after image transfer. Specific examples of film units having such a structure are described in U.S. Pat. Nos. 2,983,606, 3,415,644, 3,415,645, 3,415,646, 3,594,164 and 3,594,165, etc.

In one non-delamination type film unit, a silver halide emulsion associated with a dye image-providing material is coated on a support which does not transmit light. This film unit is imagewise exposed from the opposite side to the support. After exposure, a processing composition is spread between the surface of the silver halide emulsion layer and the image-receiving layer provided on a transparent support. The processing composition contains a light-reflecting material, and the dye images formed by diffusion through the processing solution layer to the image-receiving layer are viewed through the transparent support. With this film unit, it is necessary to use a camera having a special optical inversion system, e.g., a mirror, etc., in order to obtain non-inverted normal images.

In another non-delamination type film unit, a silver halide emulsion associated with a dye image-providing material is coated on a transparent support. This film unit is imagewise exposed through the support. After imagewise exposure, a processing composition is spread between the surface of the silver halide emulsion layer and the image-receiving layer on the transparent support. Dye images diffused through the processing solution and fixed in the image-receiving layer are then viewed through the transparent support with the light-reflecting material for a background, the light-reflecting substance having previously been spread as a layer between the silver halide emulsion layer and the image-receiving layer or having been present in the processing composition and spread as a layer.

In a further non-delamination type film unit, the material comprises a transparent support having coated thereon, in sequence, an image-receiving layer, a light-reflecting layer, a light absorbent-containing light-intercepting layer and a silver halide emulsion layer associated with a dye image-providing material.

This material is imagewise exposed from the opposite side to the support. Then, a processing composition is spread on the surface of silver halide emulsion. Dye images diffused through the light-intercepting layer and the light-reflecting layer and fixed in the image-receiving layer are viewed through the transparent support. Film units wherein the surface of the silver halide emulsion layer is covered by a transparent cover sheet and which are designed so that the unit is exposed through this cover sheet and so that a light absorbent-containing processing composition is spread between the cover sheet and the surface of the emulsion layer are particularly useful.

In the present invention, a light-reflecting material is used in order to form a white background of the dye image formed in the image-receiving layer. Suitable light-reflecting materials are titanium dioxide, barium sulfate, zinc oxide, alumina, barium stearate, calcium carbonate, silicate, zirconium oxide, kaolin, magnesium oxide, etc. These materials can be used individually or in combination. Such a light-reflecting material can be either initially formed or, as is described in Belgian Pat. Nos. 768,110 and 768,111, formed in a given position from a precursor distributed in a film unit. The light-reflecting material can be incorporated in the layer which contains a hydrophilic polymer such as polyvinyl alcohol, gelatin, hydroxypropyl cellulose, polyvinyl pyrrolidone, etc., as a binder. Furthermore, the light-reflecting material can be compounded in the processing composition so that, upon spreading of the processing composition, the light-reflecting material is fixed in a dispersed state in a layer of a film-forming polymer such as hydroxyethyl cellulose of carboxymethyl cellulose formed upon spreading. The combined use of the light-reflecting material and a fluorescent brightening agent such as stilbene, coumarin, triazine, oxazole, etc., provides a beautiful white background. In order to protect the silver halide emulsion layer from ambient light during processing it is advantageous to incorporate a dye which is colored at a pH higher than the pKa of the dye and becomes colorless at a pH less than the pKa of the dye as is described in Belgian Pat. Nos. 743,336, 768,107 and 768,109. The light-reflecting material-containing layer advantageously possesses a light-reflecting material/binder polymer composition ratio (by weight) of about 0.5:1 to about 100:1, and generally has a dry thickness of about 5μ to 50μ. Also, this layer possesses a reflectivity of not less than about 50%, preferably not less than 70%.

As described above, the processing composition of the photographic material of the present invention can be retained in a rupturable container. When pressed by pressure-applying members, this container is ruptured due to the internal pressure to release the processing composition in a predetermined manner. A variety of pressure-applying members can be used. In particular, a pressure applying means which comprises at least one pair of members juxtaposed with a certain gap or clearance is suited for the processing of the film unit of the present invention. A pair of members are fixedly positioned with a certain clearance or oppose each other through a spring or like elastic body. The members may be rod-shaped freely rotating rollers or motor-driven rollers. Upon passage between a pair of juxtaposed pressure-applying members, the container is ruptured and the processing composition is released and spread between the two elements in a layer form. Those juxtaposed pressure-applying members as described in U.S. Pat. Nos. 3,647,441 and 3,652,281 can be advantageously used.

In the photographic material of the present invention, development processing can be continued outside a camera in a bright place. The silver halide emulsion layer is protected from ambient light until development and transfer of the dye images are substantially completed. For this purpose, it is advantageous to dispose a light absorbent-containing light-intercepting layer on the side of the silver halide emulsion layer. The light-intercepting layer is rendered processing composition-permeable (hydrophilic) or processing composition-impermeable (dimensionally stable) depending upon the position of the light-intercepting layer. A processing composition-permeable, light-intercepting layer is a water-permeable polymer layer such as a gelatin, polyvinyl alcohol, polyacrylamide, polyhydroxyethyl cellulose, sodium carboxymethyl cellulose, methyl cellulose, etc., layer containing a light-intercepting material. The layer can be coated as a complete layer or can be spread, upon processing, as a processing solution layer.

The dimensionally stable light-intercepting layer can be a light absorbent-containing polymer layer as described in Japanese Patent Publication No. 24547/68 and U.S. Pat. No. 3,607,818, and can be contained in the photographic material as a support or a light-intercepting element. The dimensionally stable, light-intercepting layer can also be prepared from a foil of a metal such as aluminum or tin, a laminated film of a metal foil and a polymer, an aluminum-vacuum deposited polyethylene terephthalate film or from a laminate film. From the viewpoint of light-intercepting property and appearance, the light-intercepting layer preferably is covered with a light-reflecting material such as titanium oxide. Various light-absorbing materials can be used in the light-intercepting layer. In particular, carbon powder (e.g., carbon black, etc.), silver colloid, organic pigments (e.g., azo lake, copper phthalocyanine, etc.), water-insoluble azo dyes, anthraquinone dye dispersions, polymers reacted with a reactive dye, micelle-forming hydrophilic dyes, etc., are useful.

The necessary light-intercepting ability of the light-intercepting layer used in the present invention varies depending upon the end-use purposes of the photographic material. However, generally speaking, in many cases the layer should possess an absorbance (scattered light) of not less than about 3, preferably not less than 5 throughout the wavelength region of about 350 to 650 mμ, preferably about 300 to 750 mμ. The dimensionally stable light-intercepting layer is advantageously used as an adhesive tape for intercepting light at the edges of a transparent support in order to prevent light leakage to the silver halide emulsion layers through the edges of the photographic material.

The following examples are given for the purpose of a further understanding of this invention. However, the invention is not to be construed as being limited to these examples.

EXAMPLE 1

A multilayer photosensitive element was prepared by coating, in succession, the following layers on a transparent cellulose acetate film of a thickness of 100 microns.

1. Diffusible Cyan Dye-Providing Coupler Layer

A coated layer of 1-hydroxy-4-hexadecyloxy-N-ethyl-3',5'-dicarboxy-2-naphthanilide having the following structure:

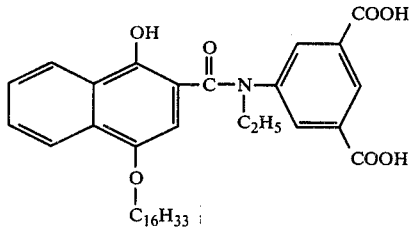

at a coverage of $1.70 \times 10^{-3}$ mol/m$^2$ and colloidal silver at coverages of 0.77 g/m$^2$ of gelatin and $3.62 \times 10^{-2}$ g/m$^2$ of silver;

2. Spacer Scavenger Layer

A layer containing a non-diffusible cyan coupler, 1-hydroxy-2-dodecylnaphthamide at a coverage of $3.82 \times 10^{-4}$ mol/m$^2$, a non-diffusible cyan coupler, 1-hydroxy-N-[(2,4-di-tert-amylphenoxy)propyl]-2-naphthamide at a coverage of $1.20 \times 10^{-4}$ mol/m$^2$, 2,5-di-tert-octylhydroquinone at a coverage of $7.0 \times 10^{-4}$ mol/m$^2$, di-n-butyl phthalate at a coverage of 0.51 g/m$^2$, and gelatin at a coverage of 0.9 g/m$^2$.

3. Blue-Sensitive Silver Iodobromide Emulson Layer

A blue-sensitive gelatino silver iodobromide emulsion layer (Ag $1.13 \times 10^{-2}$ mol/m$^2$, gelatin 1.22 g/m$^2$, iodide 4.0 mol%, and mean grain size 0.8 micron) containing a non-diffusible cyan coupler, 1-hydroxy-2-dodecylnaphthamide at a coverage of 0.37 mol/m$^2$, a non-diffusible cyan coupler, 1-hydroxy-N-[(2,4-di-tert-amylphenoxy)propyl]-2-naphthamide at a coverage of 0.12 mol/m$^2$, 2,5-di-tert-octylhydroquinone at a coverage of $2.35 \times 10^{-4}$ mol/m$^2$, and di-n-butyl phthalate at a coverage of 1.12 g/m$^2$.

4. Protective Layer

A protective layer containing 0.63 g/m$^2$ of gelatin.

The multilayer photosensitive element thus prepared was exposed (20 CMS) to a tungsten light of 1 kw at a color temperature of 2854° K.

A processing solution having the following composition was placed in a processing pod and used for processing the multilayer photosensitive element. The processing pod was made by folding a laminate film composed of a polyethylene film, an aluminum foil, a cellophane film, and a polyethylene film and heat-sealing together to form a cavity capable of containing about 2 ml of the processing solution. The processing pod was also so made that it could be easily ruptured by pressing.

| Processing Composition | | |
|---|---|---|
| Water | 100 | ml |
| Ascorbic Acid | 20 | ml |
| 4-Amino-3-methyl-N-ethyl-N-(β-hydroxyethyl)aniline sulfate (monohydrate) | 2.8 | g |
| Sodium Hydroxide | 7.0 | g |
| 6-Nitrobenzimidazole Nitrate | 1.5 | mg |
| Sodium Carboxymethyl Cellulose | 3.5 | g |
| Titanium Dioxide | 45.0 | g |

The preparation of the processing solution and the insertion of the processing solution in the processing pod were under an atmosphere of a Freon gas (Freon 12).

The multilayer photosensitive element and each of the image-receiving elements having the following structures were cut into an area of 10 cm × 8 cm, both elements were superposed over each other so that the coated layer of the former faced the coated layer of the latter and the processing pod could supply the processing solution therebetween. Then, the assembly was pressed to spread the processing solution between both elements at 2.0 ml/100 $cm^2$ to perform the development and the transfer of the dye images formed. The reflection densities of the dye images thus transferred into the image-receiving element were measured using a red filter and a blue filter (interference filters having a spectral transmission maximum at 645 nm and 436 nm, respectively, made by Nippon Shinku Kogaku K.K.). The density measurement was made using a P-type Densitometer made by Fuji Photo Film Co., Ltd.

IMAGE-RECEIVING ELEMENT A

An image-receiving layer A was prepared by coating, in succession, the following layer on a transparent polyethylene terephthalate film of a thickness of 100 microns having a gelatin subbing layer coated on the surface of the film after treating the film with ultraviolet radiation.

1. Acid Neutralizing Layer

A layer formed by coating thereon an aqueous solution of polyacrylic acid ($[\eta]=1.1$ at 20° C.) at a coverage of 20 g/$m^2$ of the polyacrylic acid.

2. Neutralization Rate Controlling Layer

A layer formed by coating a solution of a copolymer of vinyl acetate and 2-methyl-N-vinyl imidazole (70:30 molar ratio) in a mixture of ethanol and water (4:1 by volume ratio) ($[\eta]=0.3$ at 20° C.) at a coverage of 6 g/$m^2$.

3. Image-Receiving Layer

A layer formed by coating a solution of 6 g of polyvinyl alcohol (saponification degree: 98%, and polymerization degree: 1,800), 3 g of poly-4-vinylpyridine (molecular weight of about 70,000–80,000), and 7 g of poly(-methacryloxy-ethyltriethylammonium triethyl sulfate) in 150 ml of a mixed solvent of ethanol and water of 2.5:1 at a dry thickness of 20 microns.

IMAGE-RECEIVING ELEMENT B

The image-receiving layer was prepared by following the same procedure as in the case of preparing Image-Receiving Element A except that the coating composition for the neutralization rate controlling layer contained Compound 1 described hereinbefore in an amount of 16 g per 100 ml of the coating composition. The coverage of divinyl sulfone in this case was about 5 × $10^{-2}$ mol/$m^2$.

IMAGE-RECEIVING ELEMENT C

This image-receiving element was prepared by following the same procedure as in the case of preparing Image-Receiving Element B except that the coating composition for the neutralization rate controlling layer contained Compound 2 described hereinbefore in place of Compound 1 in an amount of equimolar to the latter.

The minimum transferred density (corresponding to the exposed portion) and the maximum transferred density (corresponding to the unexposed portion) of each image-receiving element were measured in a fresh state and 1 day (1 day) after the formation of the images. The results are shown in the following table.

TABLE 1

| Image-Receiving Element | Maximum Density | | | | Minimum Density | | | |
|---|---|---|---|---|---|---|---|---|
| | Fresh | | 1 Day | | Fresh | | 1 Day | |
| | R | B | R | B | R | B | R | B |
| A | 2.18 | 0.60 | 1.52 | 0.97 | 0.16 | 0.28 | 0.89 | 0.4o |
| B | 2.20 | 0.40 | 2.23 | 0.43 | 0.15 | 0.20 | 0.18 | 0.23 |
| C | 2.16 | 0.55 | 2.02 | 0.62 | 0.18 | 0.23 | 0.20 | 0.28 |

In the above table, the change in density R in the maximum density portion is the fading of the cyan dye image, the change in density B in the maximum density portion shows the increase of yellow, i.e., yellow stain (mainly the oxidation product of a color developing agent), and further the change in density R in the minimum density portion shows the scale of the cyan density, that is, mainly the amount of post transfer (the increased amount of the dye formed by the coupling of a coupler and a color developing agent oxidized by the oxygen contained in air or water) and the change in density B in the minimum density portion shows the increase of yellow stain (mainly the oxidation product of a color developing agent).

Thus, as is clear from the results shown in Table 1, Image-Receiving Elements B and C containing the compounds used in this invention have less fading of the cyan dye images, less post transfer, and further less formation of yellow stain as compared with Image-Receiving Element A. Thus, it is clear that by the incorporation of the compounds used in this invention, the fading of the color image formed, the occurrence of post transfer, and the formation of yellow stain are greatly reduced.

EXAMPLE 2

A multilayer photosensitive element was prepared by coating, in succession, the following layers on a transparent cellulose acetate film.

1. Blue-Sensitive Silver Halide Emulsion Layer

A layer containing a silver iodobromide emulsion layer (containing 4 mol% of iodide and $5.9 \times 10^{-2}$ mol of Ag per 100 g of the emulsion) at a coverage of $8.5 \times 10^{-3}$ mol/m$^2$ of silver, 4-hydroxy-6-methyl-1,3,3a,7-tetrazaindene at a coverage of $7 \times 10^{-3}$ g/m$^2$, sodium dodecylbenzenesulfonate at a coverage of 2.2 g/m$^2$, benzoylaceto-2-methoxy-5-tetradecyloxycarbonylacetanilide at a coverage of 0.3 g/m$^2$, 2-methylbenzoylaceto-2-chloro-5-dodecyloxycarbonylacetanilide at a coverage of 0.7 g/m$^2$, 2-methylbenzoylaceto-2-chloro-5-cetyloxycarbonylacetanilide at a coverage of 0.3 g/m$^2$, 2,5-di-tert-octylhydroquinone at a coverage of $2.4 \times 10^{-2}$ g/m$^2$, and poly-p-sulfostyrene sodium salt at a coverage of $1.5 \times 10^{-2}$ g/m$^2$.

2. Interlayer

A layer containing gelatin at a coverage of 0.6 g/m$^2$, sodium dodecylbenzenesulfonate at a coverage of $1.8 \times 10^{-2}$ g/m$^2$, benzoylaceto-2-chloro-5-dodecyloxycarbonylacetanilide at a coverage of 0.4 g/m$^2$, 1-(2,4,6-trichlorophenyl)-3-{3-[α-(2,4-di-tert-amylphenyloxy)-propylamino]phenylureido}-5-pyrazolone at a coverage of 0.17 g/m$^2$, and poly-p-sulfoethylene sodium salt at a coverage of $2.4 \times 10^{-2}$ g/m$^2$.

3. Positive Nucleus Layer

A layer containing silver nuclei at a coverage of $3.3 \times 10^{-2}$ g/m$^2$, sodium dodecylbenzenesulfonate at a coverage of $2.2 \times 10^{-2}$ g/m$^2$, α-pivalyl-α-(3-octadecylcarbamylphenylthio)-3,5-di-carboxyacetanilide at a coverage of 0.13 g/m$^2$, and α-pivalyl-α-(4-octadecyloxycarbonylphenyloxy)-3,5-dicarboxy-acetanilide at a coverage of 1.19 g/m$^2$ in a gelatin medium.

4. Yellow Filter Barrier Layer

A layer containing yellow Carey-Lea type silver at a coverage of $1.0 \times 10^{-2}$ g/m$^2$, silver nucleus at a coverage of $0.9 \times 10^{-4}$ g/m$^2$, sodium dodecylbenzenesulfonate at a coverage of $2.3 \times 10^{-2}$ g/m$^2$, benzoylaceto-2-chloro-5-dodecyloxycarbonyl-acetanilide at a coverage of $5.1 \times 10^{-1}$ g/m$^2$, 1-(2,4,6-trichlorophenyl)-3-{3-[α-(2,4-di-tert-amylphenyloxy)propylamido]-phenylureido}-5-pyrazolone at a coverage of 0.22 g/m$^2$, poly-p-sulfostyrene sodium salt at a coverage of 0.8 g/m$^2$, and the sodium salt of 2,4-dichloro-6-hydroxy-1,3,5-triazine at a coverage of 0.8 g/m$^2$ in a gelatin medium.

5. Positive Nucleus Layer

A layer containing silver nuclei at a coverage of $2.3 \times 10^{-2}$ g/m$^2$, sodium dodecylbenzenesulfonate at a coverage of $1.5 \times 10^{-2}$ g/m$^2$, 1-(2,4,6-trichloro)-3-(3,5-dicarboxybenzamino)-4-(3-octadecylcarbamylphenylthio)-5-pyrazolone at a coverage of 1.16 g/m$^2$, poly-p-sulfostyrene sodium salt at a coverage of $2.1 \times 10^{-2}$ g/m$^2$, and 2,4-dichloro-6-hydroxy-1,3,5-triazine sodium salt at a coverage of $1.0 \times 10^{-2}$ g/m$^2$ in a gelatin medium.

6. Interlayer

A layer containing gelatin at a coverage of 0.6 g/m$^2$, sodium dodecylbenzenesulfonate at a coverage of $1.8 \times 10^{-2}$ g/m$^2$, benzoylaceto-2-methoxy-5-tetradecyloxycarbonylacetanilide at a coverage of 0.15 g/m$^2$, 2-methylbenzoylaceto-2-chloro-5-dodecyloxycarbonylacetanilide at a coverage of 0.3 g/m$^2$, 2-methylbenzoylaceto-2-chloro-5-cetyloxycarbonylacetanilide at a coverage of 0.15 g/m$^2$, and poly-p-sulfostyrene sodium salt at a coverage of $2.4 \times 10^{-2}$ g/m$^2$.

7. Green-Sensitive Silver Halide Emulsion Layer

A layer containing a silver iodobromide emulsion (containing 4 mol% iodide and $5.9 \times 10^{-2}$ mol of silver per 100 g of the emulsion) at a coverage of $9.7 \times 10^{-3}$ mol/m$^2$ of silver, the spectral sensitizing dyes having the following structures:

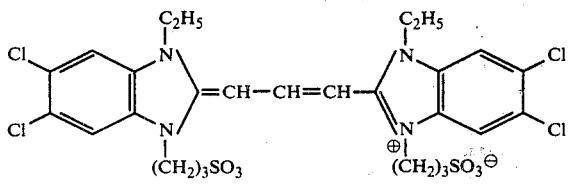

and

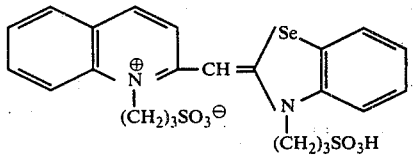

at coverages of $1.3 \times 10^{-3}$ g/m$^2$ and $4.9 \times 10^{-4}$ g/m$^2$, respectively, 4-hydroxy-6-methyl-1,3,3a,7-tetrazaindene at a coverage of $8.2 \times 10^{-3}$ g/m$^2$, and sodium dodecylbenzenesulfonate at a coverage of $2.5 \times 10^{-2}$ g/m$^2$.

8. Interlayer

Same as Interlayer 2.

9. Positive Nucleus Layer

Same as Positive Nucleus Layer 5.

10. Barrier Layer

A layer containing silver nuclei at a coverage of $3.3 \times 10^{-2}$ g/m$^2$, sodium dodecylbenzenesulfonate at a coverage of $2.1 \times 10^{-2}$ g/m$^2$, benzoylaceto-2-chloro-5-dodecyloxycarbonyl-acetanilide at a coverage of 0.5 g/m$^2$, 1-(2,4,6-trichlorophenyl)-3-{3-[α-(2,4-di-tert-amylphenoxy)propylamido]phenylureido}-5-pyrazolone at a coverage of 0.21 g/m$^2$, poly-p-sulfostyrene sodium salt at a coverage of $2.9 \times 10^{-2}$ g/m$^2$, and 2,4-dichloro-6-hydroxy-1,3,5-triazine sodium salt at a coverage of $2.9 \times 10^{-2}$ g/m$^2$ in a gelatin medium.

11. Positive Nucleus Layer

A layer containing silver nuclei at a coverage of $2.3 \times 10^{-2}$ g/m$^2$, sodium dodecylbenzenesulfonate at a coverage of $1.5 \times 10^{-2}$ g/m$^2$, 1-hydroxy-4-hexadecyloxy-N-ethyl-3',5'-dicarboxy-2-naphthanilide at a coverage of 0.9 g/m$^2$, poly-p-sulfostyrene sodium salt at a coverage of $2 \times 10^{-2}$ g/m$^2$, and 2,4-dichloro-6-hydroxy-1,3,5-triazine sodium salt at a coverage of $3 \times 10^{-2}$ g/m$^2$ in a gelatin medium.

12. Interlayer

Same as Interlayer 2.

13. Red-Sensitive Silver Halide Emulsion Layer

A layer containing a silver iodobromide emulsion (containing 4 mol% iodide and $5.9 \times 10^{-2}$ mol of silver per 100 g of the emulsion) at a coverage of $1.0 \times 10^{-3}$ mol/m$^2$ of silver, the spectral sensitizing dyes having the following formulae:

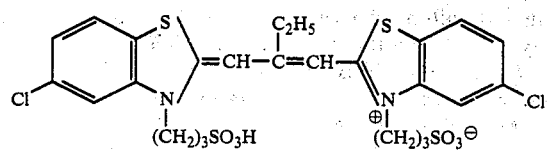

and

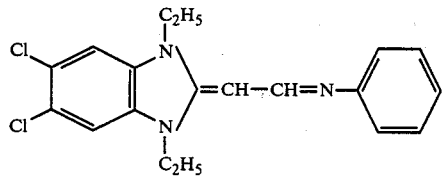

at coverages of $9 \times 10^{-4}$ g/m$^2$ and $6 \times 10^{-4}$ g/m$^2$, respectively, 4-hydroxy-6-methyl-1,3,3a,7-tetrazaindene at a coverage of $9 \times 10^{-3}$ g/m$^2$, sodium dodecylbenzenesulfonate at a coverage of $2.7 \times 10^{-2}$ g/m$^2$, benzoylaceto-2-chloro-5-dodecylcarbonylacetanilide at a coverage of 0.9 g/m$^2$, 1-(2,4,6-trichlorophenyl)-3-{3-[α-(2,4-di-tert-amylphenoxy)propylamido]-phenylureido}-5-pyrazolone at a coverage of 0.4 g/m$^2$, 2,5-di-tert-octylhydroquinone at a coverage of 0.9 g/m$^2$, and poly-p-sulfostyrene at a coverage of $1.8 \times 10^{-2}$ g/m$^2$.

14. Interlayer

Same as Interlayer 2.

15. Positive Nucleus Layer

Same as Positive Nucleus Layer 11.

The multilayer photosensitive element thus prepared was subjected to light exposure of 20 CMS using a tungsten light of 1 kw at a color temperature of 2845° K. Then, using the processing composition as used in Example 1 and each of the Image-Receiving Elements A, B, and C as used in Example 1, the processing composition was spread between the photosensitive element and the image-receiving element superimposed on each other with an interval of about 250 microns at a coverage of 2.5 ml per 100 cm$^2$. The reflection densities of the color images thus transferred into the image-receiving element were measured using a red filter, a green filter and a blue filter (interference filters having spectral transmission maxima at 645 nm, 546 nm, and 436 nm, respectively, made by Nippon Shinku Kogaku K.K.). The density measurement was carried out using a P-type Densitometer made by Fuji Photo Film Co., Ltd. The minimum transferred density and the maximum transferred density of the color images were measured in the fresh state and after 1 day, with the results being shown in Table 2.

TABLE 2

| Image-Receiving Element | Maximum Density | | | | | | Minimum Density | | | | | |
|---|---|---|---|---|---|---|---|---|---|---|---|---|
| | Fresh | | | After 1 Day | | | Fresh | | | After 1 Day | | |
| | R | G | B | R | G | B | R | G | B | R | G | B |
| A | 1.48 | 1.30 | 1.40 | 0.70 | 1.92 | 2.01 | 0.20 | 0.28 | 0.30 | 0.53 | 0.99 | 0.70 |
| B | 1.49 | 1.32 | 1.48 | 1.50 | 1.32 | 1.52 | 0.20 | 0.29 | 0.30 | 0.23 | 0.32 | 0.33 |
| C | 1.52 | 1.50 | 1.52 | 1.48 | 1.50 | 1.58 | 0.21 | 0.30 | 0.35 | 0.25 | 0.32 | 0.40 |

In Table 2, the changes in densities R, G and B in the maximum density portion show mainly the degree of fading of the cyan, magenta, and yellow color images, respectively, the changes in densities R, G, and B in the minimum density portion show the degree of post transferred amounts of cyan, magenta and yellow, respectively, and further density B shows also the increased amount of yellowish stain in the density. Therefore, as is clear from the results of Table 2, by the addition of the compounds used in this invention, the fading of the color images and the occurrence of post transfer are greatly reduced as in Example 1.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material comprising a photosensitive element containing at least one silver halide emulsion layer having associated therewith a non-diffusible dye image-providing material; an image-receiving element for immobilizing therein a diffusible dye formed by the oxidation reaction of the dye image-providing material and a primary aromatic amino color developing agent to form dye images; a processing composition for developing silver halide in the silver halide emulsion layer once the silver halide is exposed and transferring by diffusion the diffusible dye to the image-receiving element and with at least one of the photosensitive element, the image-receiving element and the processing composition containing a primary aromatic amino color developing agent or a precursor thereof; with at least one of said photosensitive element and said image-receiving element of the photographic material having incorporated therein a material which both prevents color image fading and reduces the formation of stain in blank areas which is at least one of (1) divinyl sulfone and (2) a divinyl sulfone derivative represented by the general formula:

$$B-CH_2CH_2-\overset{\overset{O}{\|}}{\underset{\underset{O}{\|}}{S}}-CH_2CH_2-B \,.\, (X^{\ominus})_n$$

wherein B represents an ammonium group represented by the formula:

$$-\overset{\overset{R_1}{|}}{\underset{\underset{R_3}{|}}{N^{\oplus}}}-R_2$$

wherein $R_1$, $R_2$ and $R_3$, which may be the same or different, each represents a saturated or unsaturated, straight chain or branched chain aliphatic group having 1 to 7 carbon atoms; and $R_1$, $R_2$ and $R_3$ may combine with each other to form a 5-membered ring or a 6-membered ring; $X^-$ represents an acid anion; and $n$ is 0, 1 or 2.

2. The color diffusion transfer photographic material as set forth in claim 1, wherein said divinyl sulfone or divinyl sulfone derivative is present in the photosensitive element or the image-receiving element in an amount of more than about $10^{-3}$ mol/m$^2$.

3. The color diffusion transfer photographic material as set forth in claim 1, in which said divinyl sulfone or divinyl sulfone derivative is present in the photosensitive element or the image-receiving element in an amount of from about $10^{-3}$ mol/m$^2$ to about 10 mol/m$^2$.

4. The color diffusion transfer photographic material as set forth in claim 1, in which said divinyl sulfone or divinyl sulfone derivative is present in the image-receiving element of the photographic material.

5. The color diffusion transfer photographic material as set forth in claim 4, in which said divinyl sulfone or divinyl sulfone derivative is incorporated in at least one of an image-receiving layer, a neutralization rate controlling layer, and a neutralizing layer forming said image-receiving element, which layers occur in the order: said neutralizing layer, said neutralization rate controlling layer and said image-receiving layer.

6. The color diffusion transfer photographic material as set forth in claim 4, in which said divinyl sulfone or divinyl sulfone derivative is present in an additional layer formed in the image-receiving element.

7. The color diffusion transfer photographic material as set forth in claim 1, wherein said divinyl sulfone or divinyl sulfone derivative is:

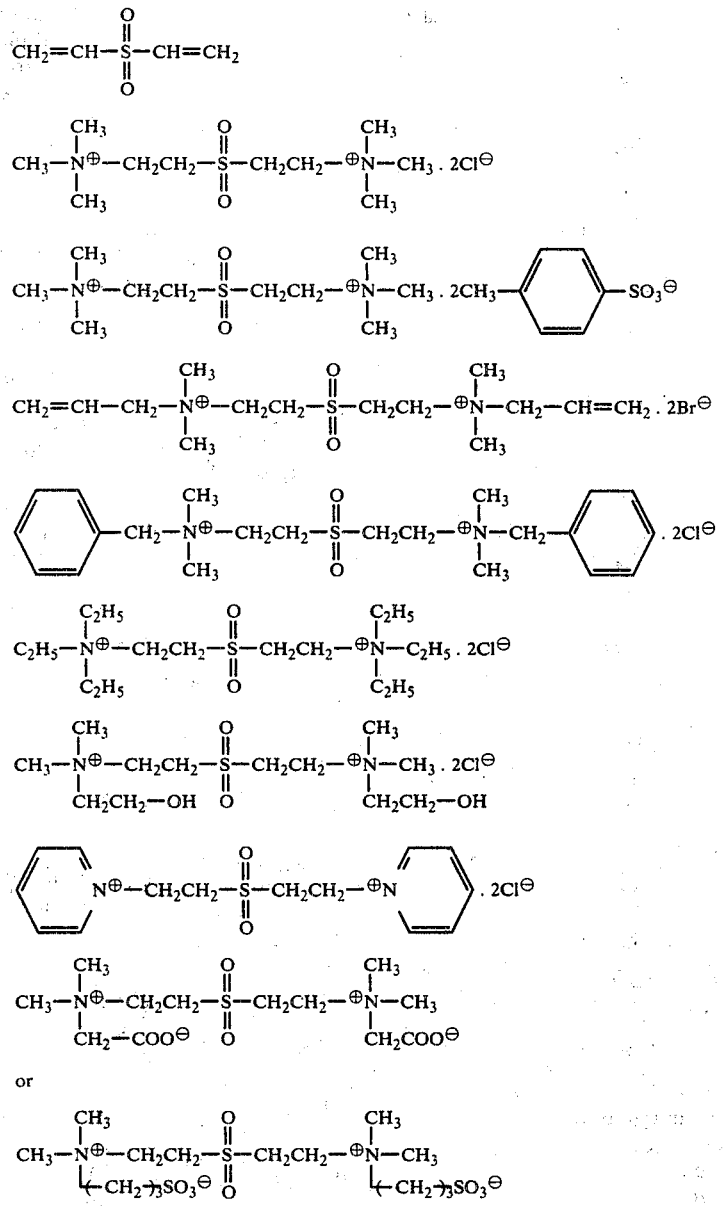

8. The color diffusion transfer photographic material as set forth in claim 7, wherein said divinyl sulfone or divinyl sulfone derivative is:

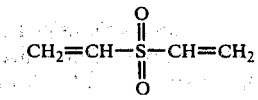

9. The color diffusion transfer photographic material as set forth in claim 7, wherein said divinyl sulfone or divinyl sulfone derivative is:

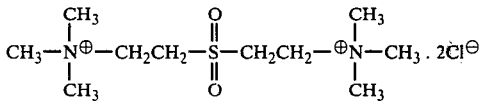

10. The color diffusion transfer photographic material as set forth in claim 8, wherein the image-receiving element comprises, in order, a neutralizing layer, a neutralizing rate controlling layer, and an image-receiving layer, and wherein said divinyl sulfone or said divinyl sulfone derivative is incorporated in said neutralizing rate controlling layer.

11. The color diffusion transfer photographic material as set forth in claim 9, wherein the image-receiving element comprises, in order, a neutralizing layer, a neutralizing rate controlling layer, and an image-receiving layer, and wherein said divinyl sulfone or said divinyl sulfone derivative is incorporated in said neutralizing rate controlling layer.

12. The color diffusion transfer photographic material as set forth in claim 1, wherein $R_1$, $R_2$ and $R_3$ each represents a saturated aliphatic group having 1 to 7 carbon atoms.

13. The color diffusion transfer photographic material as set forth in claim 1, wherein $R_1$, $R_2$ and $R_3$ each represents a unsaturated aliphatic group having 1 to 7 carbon atoms.

14. The color diffusion transfer photographic material as set forth in claim 1, wherein $R_1$, $R_2$ and $R_3$ combine with each other to form a 5-membered or 6-membered ring.

15. The color diffusion transfer photographic material as set forth in claim 14, wherein said ring is selected from the group consisting of

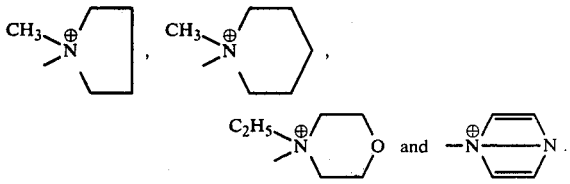

* * * * *